US007239825B2

(12) United States Patent
Ohama et al.

(10) Patent No.: US 7,239,825 B2
(45) Date of Patent: Jul. 3, 2007

(54) IMAGE FORMATION APPARATUS HAVING A PLURALITY OF UNITS AND ASSEMBLING METHOD THEREOF

(75) Inventors: Takashi Ohama, Iwakura (JP); Ryoichi Matsushima, Kuwana (JP); Yoshinori Osakabe, Nagoya (JP); Hiroshi Uchigashima, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/746,058

(22) Filed: Dec. 29, 2003

(65) Prior Publication Data

US 2004/0247337 A1 Dec. 9, 2004

(30) Foreign Application Priority Data

Dec. 27, 2002 (JP) ..... P2002-379794

(51) Int. Cl.
*G03G 15/00* (2006.01)

(52) U.S. Cl. ..... 399/107

(58) Field of Classification Search ..... 399/107, 399/113, 110

See application file for complete search history.

(56) References Cited

U.S. PATENT DOCUMENTS 5,341,196 A * 8/1994 Hodoshima et al. ..... 399/13
5,493,365 A * 2/1996 Matsui et al. ..... 399/1
6,023,598 A * 2/2000 Nishimura ..... 399/203
6,366,747 B1 * 4/2002 Roller ..... 399/110

FOREIGN PATENT DOCUMENTS

| | | | |
|---|---|---|---|
| JP | 05-048024 | | 6/1993 |
| JP | 05264916 | A * | 10/1993 |
| JP | A 8-006337 | | 1/1996 |
| JP | A 08-339101 | | 12/1996 |
| JP | A 9-244161 | | 9/1997 |
| JP | A 09-261422 | | 10/1997 |
| JP | A 9-261422 | | 10/1997 |
| JP | A 11-25884 | | 1/1999 |
| JP | A 11-119496 | | 4/1999 |
| JP | A 11-122406 | | 4/1999 |
| JP | A 11-174761 | | 7/1999 |
| JP | A 2001-290323 | | 10/2001 |
| JP | A 2002-14496 | | 1/2002 |
| JP | A 2002-82590 | | 3/2002 |
| JP | A 2002-135471 | | 5/2002 |
| JP | 2002171372 | A * | 6/2002 |
| JP | A 2002-171372 | | 6/2002 |
| JP | A 2002-332127 | | 11/2002 |

* cited by examiner

*Primary Examiner*—Quana Grainger
(74) *Attorney, Agent, or Firm*—Oliff & Berridge, PLC

(57) ABSTRACT

Systems and methods provide an image formation apparatus in which an image formation apparatus main body, an image reading portion, and an operation panel portion can be efficiently assembled by mounting a joint cover to a printer main body, an operation panel unit and a scanner unit are mounted to the joint cover. By so doing, the operation panel unit and the scanner unit can be reliably assembled to the printer main body via the joint cover, the joint cover is held, and a combined machine can be lifted and carried.

31 Claims, 18 Drawing Sheets

E

E

IMAGE FORMATION APPARATUS HAVING A PLURALITY OF UNITS AND ASSEMBLING METHOD THEREOF

BACKGROUND OF THE INVENTION

1. Field of Invention

This invention relates to an image formation apparatus and the assembling method.

2. Description of Related Art

Conventionally, an image formation apparatus is known which is integrally provided with an image reading means for reading an image recorded on a document and an image formation means for image-forming information read by the image reading means onto a sheet, and is sold as a digital combined machine, a printer, or the like provided with a copier and a facsimile/network communication function.

In this type of image formation apparatus, because an image reading portion, an image formation portion and an operation portion are integrally constituted, it has been difficult, up to the present, to replace each part independently or to change the assembly; therefore, e.g., Japanese Laid-Open Patent Application 2002-171372 discloses that each part should be made into a module or a unit.

Furthermore, a pressure plate is mounted to an apparatus main body via a hinge in this type of image formation apparatus, but as disclosed in Japanese Laid-Open Patent Application 9-261422 by arranging a hinge including a damper mechanism constituted by a spring and a cam in the vicinity of a centroid of the pressure plate when the pressure plate is rotated, there is only one hinge which costs because of a strong spring and a structure body, and other hinges can be made to be less expensive.

Additionally, in this type of image formation apparatus, a substrate for controlling an apparatus is arranged. For example, Japanese Laid-Open Patent Application 1-174761 discloses that after an engine module and a paper supply module are combined, a large setting area can be ensured by mounting the image controller board over these two parts.

SUMMARY OF THE INVENTION

An object of this invention is to provide an image formation apparatus, and an assembling method of the image formation apparatus, in which an image formation apparatus main body, an image reading portion, and an operation panel portion can be efficiently assembled.

In order to accomplish the above-mentioned object, in various exemplary embodiments of the present invention, an image formation apparatus includes a plurality of operating units and a support member, the plurality of operating units are mounted on the support member cooperating with each other. Each of the plurality of the operating units is independently removable from the supporting member.

In various exemplary embodiments of the present invention, an image formation apparatus includes a document pressing member, a document table, and a hinge attaching the document pressing member to the document table along a line that substantially extends through a centroid position of the document pressing member and that is substantially perpendicular to a rotational axis of the hinge.

In various exemplary embodiments of the present invention, an image formation apparatus includes an image reading unit having a driving source, and a circuit substrate electrically connected to the driving source. The driving source and the circuit substrate are arranged on a same side, in a right/left direction, of the image formation apparatus.

In various exemplary embodiments of the present invention, a method of assembling an image formation apparatus includes providing a support member, and mounting a plurality of image formation operating units on the support member. The plurality of image formation operating units cooperate with each other. Each of the image formation operating units is independently removable from the supporting member.

The invention provides an image formation apparatus that includes an image reading device, such as a scanner, for reading image information from a document, and an image formation device, such as a main body having a photosensitive drum, for forming an image based on the image information. The image formation apparatus also includes an operation panel, such as an input panel, for receiving user inputs so that the image reading device and the image formation device are operated based on the user inputs. The image formation apparatus further includes a support device, such as a joint cover, for supporting the image reading device, the operation panel and the image formation device, so that the image reading device, the operation panel and the image formation device are each separately removable from the supporting device.

The image reading device includes a sensing device, such as a sensor for reading a document placed on a document table, a document pressing cover for pressing the document, and a hinge for hinging the document pressing cover to close and open with respect to the document reading device. The hinge is arranged on a line perpendicular to an opening/closing center axis of the document pressing cover and substantially goes through a centroid position of the document pressing cover.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the systems and methods of this invention will be described in detail, with reference to the following figures, wherein.

DETAILED DESCRIPTION OF EXEMPLARY EMBODIMENTS

Figure 12:
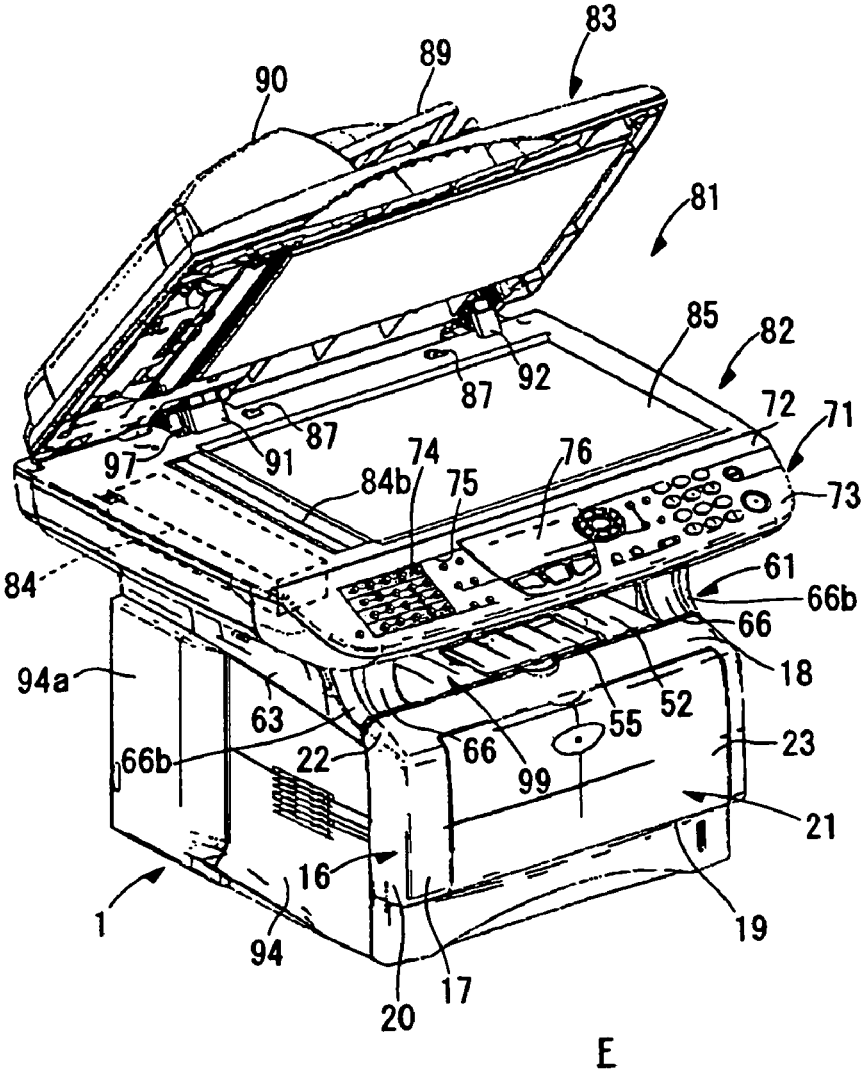
FIG. 12 is a perspective view (a state in which a document pressing cover is opened) showing a combined machine of an embodiment of an image formation apparatus of this invention.
Figure 13:
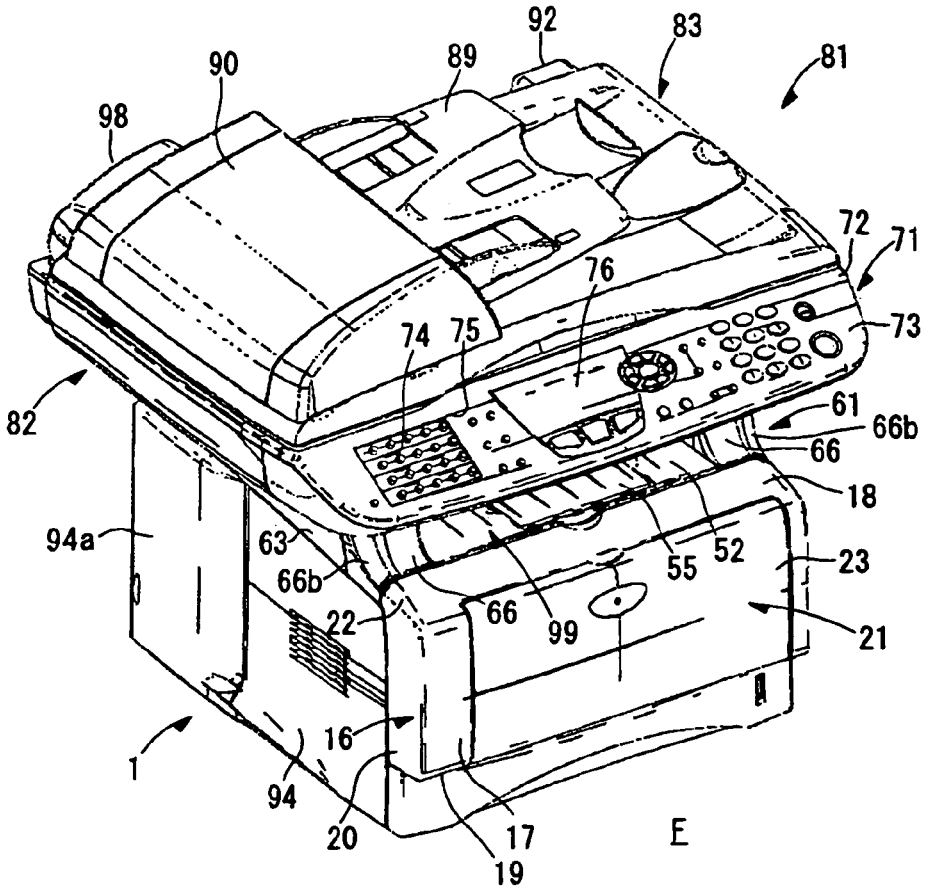
FIG. 13 is a perspective view (a state in which a document pressing cover is closed) showing a combined machine of an embodiment of an image formation apparatus of this invention.

FIGS. 12 and 13 are perspective views showing a combined machine F which is an embodiment as an image formation apparatus of this invention. In this combined machine F, a flat bed type scanner unit 81 as an image reading unit is mounted in a printer main body 1 as a main body of an image formation apparatus and is provided with a printing function, a copy function, a facsimile function, a network communication function, or the like.

Figure 1:
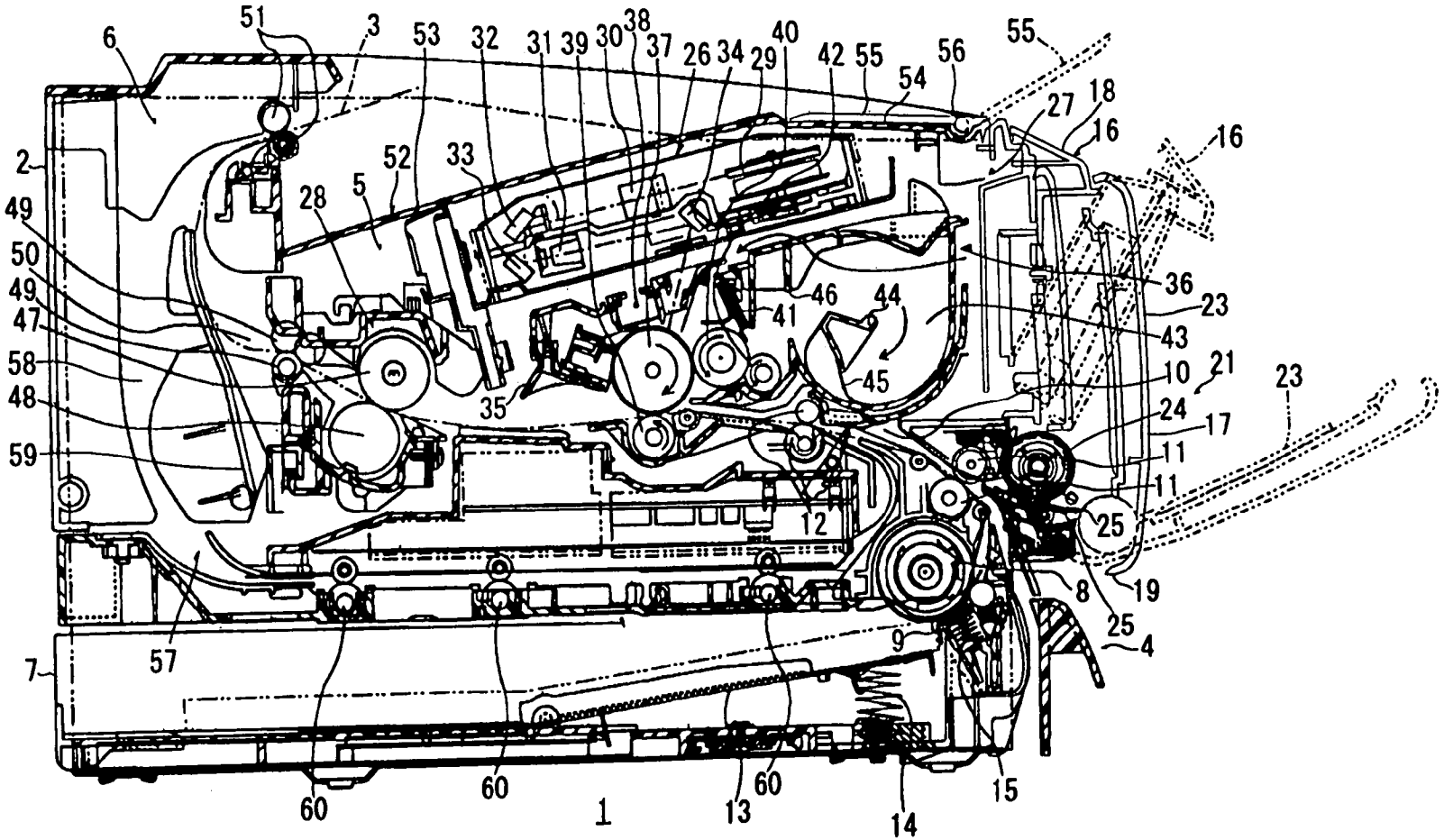
FIG. 1 is a main portion side cross-sectional view showing an embodiment of a printer main body.

FIG. 1 is a main part side cross-sectional view showing an embodiment of a printer main body 1. First, the printer main body 1 is explained with reference to FIG. 1.

In FIG. 1, the print main body 1 is constituted as a laser printer and is provided with a paper supply portion 4 which supplies paper 3 as a recording medium, an image formation portion 5 which forms an image on the supplied paper 3, an ejecting portion 6 which ejects the paper 3 in which an image has been formed, or the like within a resin main body frame 2. Additionally, in the following explanation, a side in which a paper supply roller 8 of the printer main body 1 is arranged is a front side (front surface side), and a side in which a fixing portion 28 which will be described later is arranged is a rear surface (rear surface side).

Furthermore, in a main body frame 2, a left-side frame in which a driving mechanism is mounted is formed of ABS (acrylonitrile butadiene styrene copolymer), and a right-side frame is formed of PS (polystyrene). In particular, the right- and left-side frames are formed of resin without a reinforcement agent such glass fibers.

A paper supply portion 4 is provided with a paper supply cassette 7, a paper supply roller 8 and a paper supply pad 9 which are upwardly arranged in one end side (front side) end portion of the paper supply cassette 7, a paper supply path 10 which reverses the paper 3 supplied from the paper supply roller 8 and transfers it to the back side, and a paper powder removal roller 11 and a resist roller 12 facing the paper supply path 10.

The paper supply cassette 7 is formed in a box shape of which an upper portion is open. In the bottom portion of the main body frame 2, the paper supply cassette 7 is detachably mounted to the main body frame 2 of the printer main body 1 from the front side. Within this paper supply cassette 7, a paper pressing plate 13 and a spring 14 are arranged.

The paper pressing plate 13 can stack the paper 3 in a stacked state. By being movingly supported at an end portion which is distant from the paper supply roller 8, the end portion closer to the paper supply roller 8 can be moved in an up/down direction. Additionally, the spring 14 is arranged so as to apply a rear surface of the end portion closer to the paper supply roller 8 in the paper pressing plate 13 in an upper direction. Because of this, the paper pressing plate 13 downwardly moves against an urging force of the spring 14 by using an end portion distant from the paper supply roller 8 as a fulcrum as the stacked amount of the paper 3 increases.

The paper supply roller 8 and the paper supply pad 9 are arranged in an opposed state, and the paper supply pad 9 is pressed toward the paper supply roller 8 by the spring 15 arranged in the rear side of the paper supply pad 9.

The uppermost paper 3 on the paper pressing plate 13 is pressed by the spring 14 from the rear side of the paper pressing plate 13 to the paper supply roller 8. After being sandwiched by the paper supply roller 8 and the paper supply pad 9, the paper supply roller 8 is rotated, whereby papers 3 are supplied to the paper supply path 10 as the papers 3 are separated one by one by the paper supply roller 8 and the paper supply pad 9.

Additionally, the supplied paper 3 is arranged above the paper supply roller 8 of the paper supply path 10 and is sent to a resist roller 12 after paper powder is removed by paper powder removal rollers 11 composed of a pair of rollers.

The resist roller 12 is formed of a pair of rollers and transfers the paper 3 to an image formation position (position which contacts a photosensitive drum 37 and a transfer roller 39) after resist is performed.

Furthermore, the paper supply portion 4 is further provided with a multi-purpose paper supply portion 21 in which paper can be supplied by stacking different size of paper 3. That is, in this print main body 1, a front cover 16 is arranged in a front surface of the main body frame 2, and the multi-purpose paper supply portion 21 is arranged in this front cover 16.

As shown in FIG. 12, the front cover 16 is approximately a shallow box shape in which one side (side facing the front surface of the main body frame 2) is opened. A side surface view is approximately a U shape and a front surface view is approximately a rectangular shape. A front wall 17 and, as projecting parts of a receiving surface which will be described later, an upper side wall 18, and a lower side wall 19 and two side walls 20 are integrally formed.

In the front surface of the main body frame 2, this front cover 16 is movably supported by the main body frame 2 via an undepicted hinge arranged in the lower side wall 19. As shown in imaginary lines of FIG. 1, it is arranged so that, as the upper side wall 18 moves in a front-to-back direction (a paper ejecting direction of the paper 3, hereafter the same), opening and closing can be performed with respect to the main body frame 2.

Figure 15:
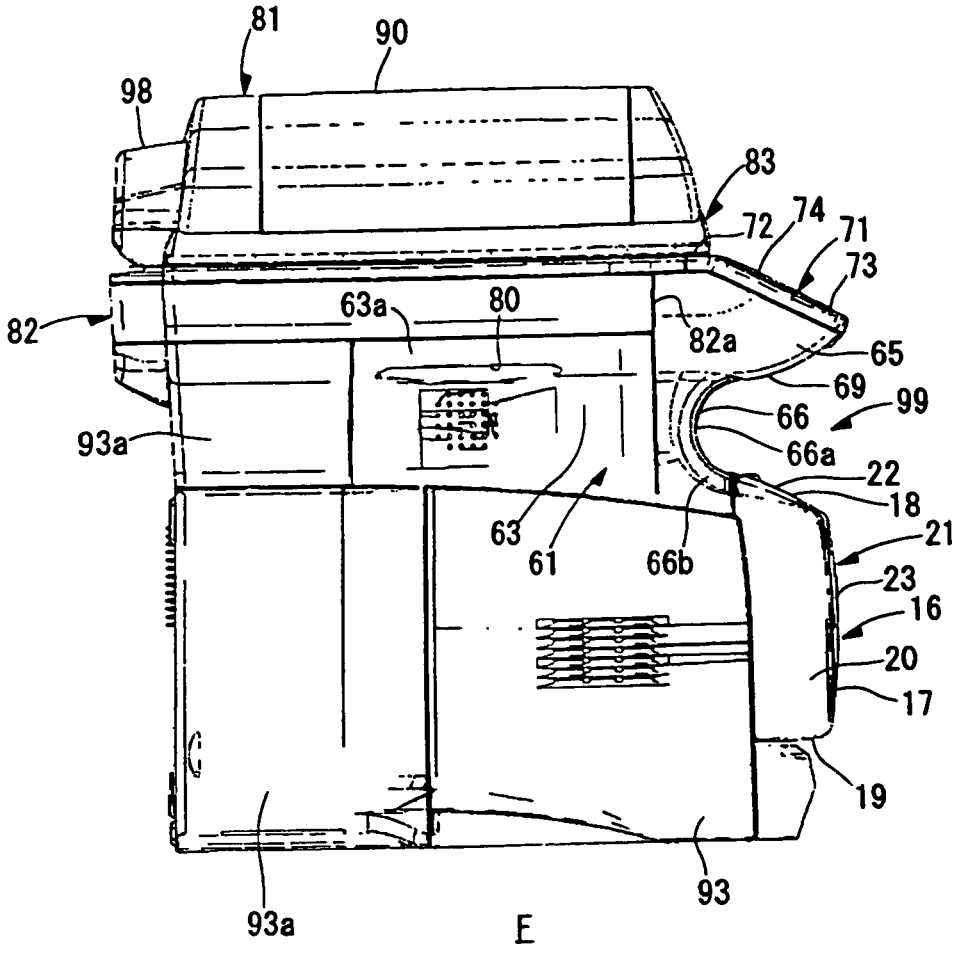
FIG. 15 is a left side view (a state in which a document pressing cover is closed) showing the combined machine shown in FIG. 13.
Figure 16:
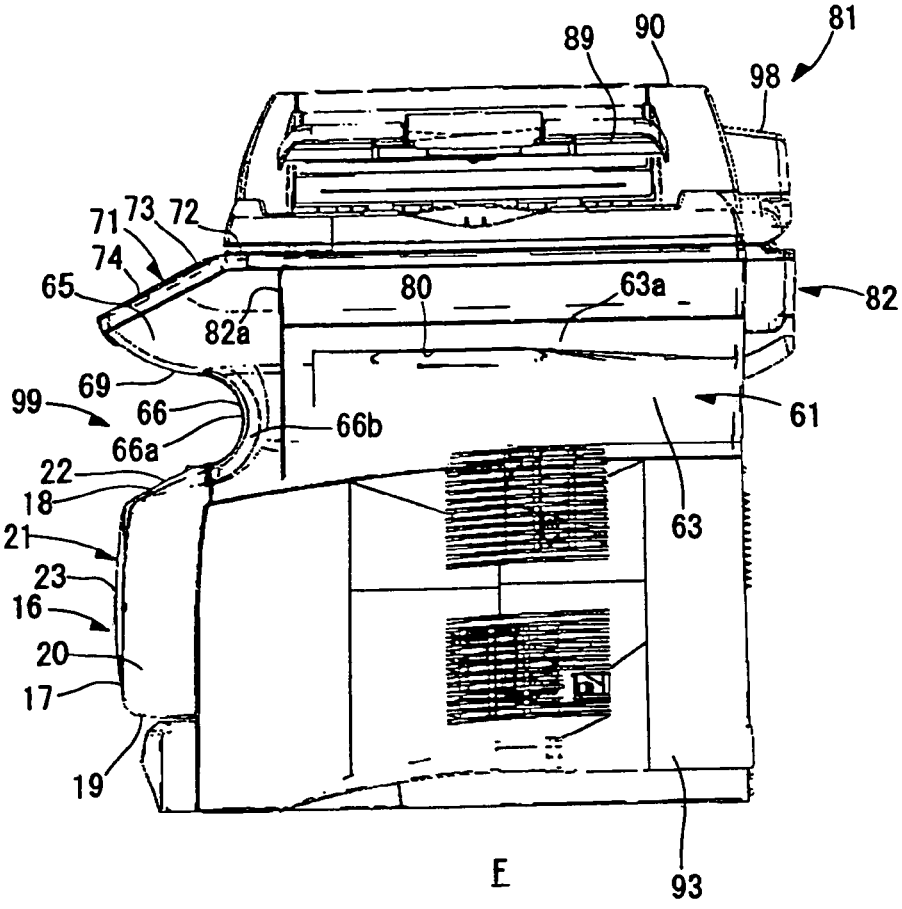
FIG. 16 is a right side view (a state in which a document pressing cover is closed) showing the combined machine shown in FIG. 13.
Figure 17:
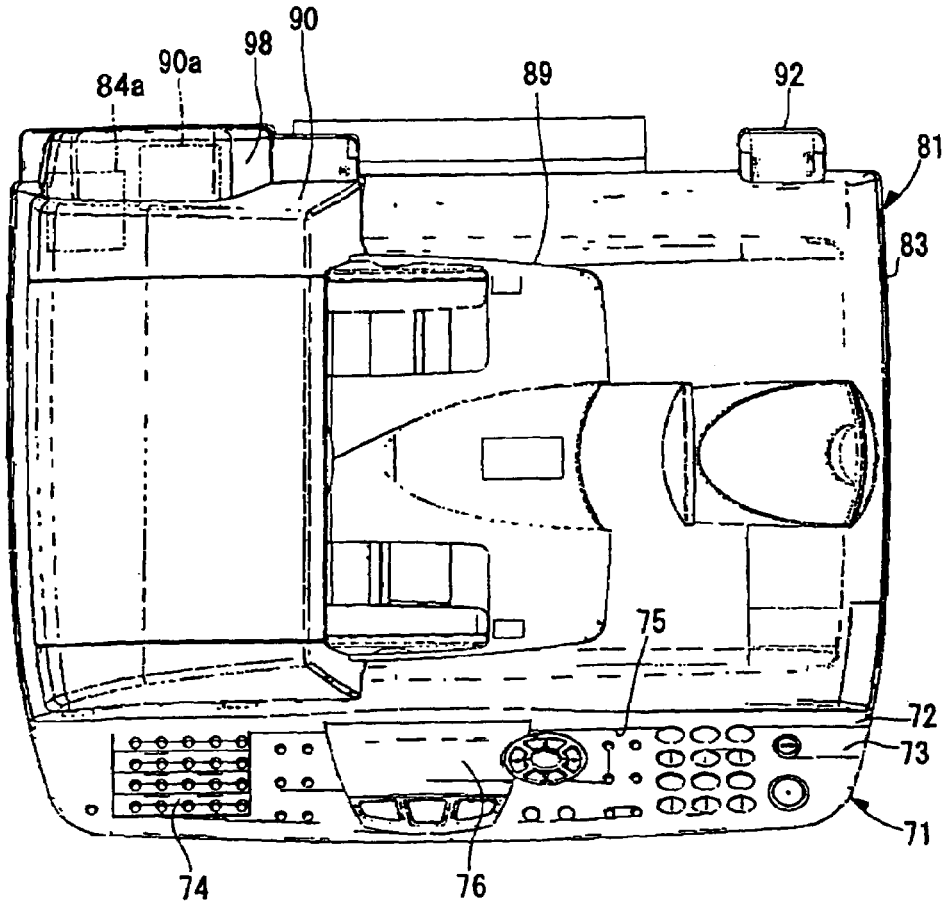
FIG. 17 is a front view (a state in which a document pressing cover is closed) showing the combined machine shown in FIG. 13.

As shown in FIGS. 15 and 16, in a perspective view, this front cover 16 projects frontward from a side cover 63 of a joint cover 61 which will be described later. The top surface of the upper side wall 18 is formed in a shape which is downwardly inclined from the rear side to the front side.

Furthermore, the main body side continuation portion 22 which is continuous with the front end concave portion 66 of the side cover 63 of the later-described joint cover 61 in the width direction (the direction perpendicular to the paper ejecting direction of the paper 3, hereafter the same) at both end portions of the upper side wall 18 is formed as a shape which is continuous with the front end concave portion 66, without any stepped portions. In the same manner as in the front end concave portion 66, an inclined portion is formed in a curved shape which is inclined rearward at both outer sides.

Additionally, as shown in FIG. 1, the multi-purpose paper supply portion 21 is provided with a multi-purpose tray 23 as a recording medium support means arranged in the front wall 17 of this front cover 16, and, within the front cover 16, a multi-purpose side paper supply roller 24 rotatably supported by the front side lower end portion of the main body frame 2, and a multi-purpose side paper supply pad 25.

As shown in FIG. 12, the multi-purpose tray 23 has a substantially rectangular plate shape in front view. As shown by imaginary lines of FIG. 1, the multi-purpose tray 23 is rotatably supported by the front wall 17 of the front cover 16 via an undepicted hinge arranged in the lower end portion and can be arranged so as to be opened and closed with respect to the front wall 17 of the front cover 16 as the upper end portion moves in a front-to-back direction.

The multi-purpose side paper supply roller 24 and the multi-purpose side paper supply pad 25 are arranged in a state in which they are opposite to each other. The multi-purpose side paper supply pad 25 is pressed toward the multi-purpose side paper supply roller 24 by an undepicted spring arranged on the rear side of the multi-purpose side paper supply pad 25. After the paper 3 stacked on the multi-purpose tray 23 in an expanded state is sandwiched between the multi-purpose side paper supply pad 25 and the multi-purpose side paper supply roller 24, the multi-purpose side paper supply roller 24 is rotated and the paper 3 is supplied to the paper supply path 10 as it is separated one by one.

The image formation portion 5 is provided with a scanner 26, a processing portion 27, a fixing portion 28, or the like.

The scanner 26 is arranged in the upper portion of the main body frame 2 and is provided with a laser light emitter (undepicted), a polygon mirror 29 which is rotatingly driven, lenses 30, 31, reflecting mirrors 32, 33, 34, or the like. As shown by chain lines, a laser beam based on image data whose light is emitted from the laser emitter goes through or reflects the polygon mirror 29, the lens 30, the reflecting mirrors 32, 33, the lens 31, and the reflecting mirror 34 in order and is irradiated by high speed scanning onto the surface of a photosensitive drum 37 of the processing portion 27.

The processing portion 27 is arranged in the lower portion of the scanner 26 and is provided with a developing cartridge 36, a photosensitive drum 37, a scorotron type charger 38, a transfer roller 39, or the like within a drum cartridge 35 which is removably mounted to the main body frame 2. Furthermore, the drum cartridge 35 is detachable from the main body frame 2 as the front cover 16 arranged at the front surface of the main body frame 2 is opened and closed.

The developing cartridge 36 is detachably mounted to the drum cartridge 35 and is provided with a developing roller 40, a layer thickness regulating blade 41, a supply roller 42, a toner hopper 43, or the like.

A non-magnetic one component of toner with positive charging properties is filled into the toner hopper 43 as a development agent. As this toner, a polymerization toner is used which can be obtained by copolymerizing a polymerization monomer, for example, a styrene group monomer such as styrene, or an acrylate group monomer such as acrylic acid, alkyl ($C_1$-$C_4$) acrylate, alkyl ($C_1$-$C_4$) metaacrylate, with a known polymerization method such as suspension polymerization or the like. This type of polymerization toner has a substantially round shape, flowability is extremely good, and image formation with high image quality can be accomplished.

Furthermore, colorant such as carbon black, and wax or the like, are mixed in this type of toner. Additionally, in order to improve flowability, an externally added agent such as silica is added. The powder grain diameter is approximately 6-10 μm.

Additionally, the toner within the toner hopper 43 is agitated by rotation, in an arrow direction (clockwise direction), of an agitator 45 supported by a rotating shaft 44 arranged in the center of the toner hopper 43, and is ejected from a toner supply port 46 which opens on a side portion of the toner hopper 43.

At the side position of the toner supply port 46, a supply roller 42 is rotatably arranged, and a developing roller 40 is rotatably arranged opposite to this supply roller 42. Additionally, the supply roller 42 contacts the developing roller 40 in a state in which the respective rollers are compressed to some degree.

The supply roller 42 is rotatingly driven in an arrow direction (counterclockwise direction). The supply roller 42 is made of conductive foam material covered over a metal roller shaft.

Furthermore, the developing roller 40 is rotatingly driven in an arrow direction (counterclockwise direction). The roller 40 is made of conductive rubber material covered over a metal roller shaft. More specifically, the roller of the developing roller 40 is composed of a coating layer of urethane rubber or silicon rubber containing fluorine covered onto the surface of a roller main body made of conductive urethane rubber or silicone rubber containing carbon micro powder or the like. Furthermore, it is constituted such that a developing bias is applied to the developing roller 40.

Additionally, the layer thickness regulating blade 41 is arranged in the vicinity of the developing roller 40. This layer thickness regulating blade 41 is provided with a cross-sectional half-round shaped pressing portion made of insulating silicone rubber at the tip end portion of the blade main body made of metal plate spring material, is supported by the developing cartridge 36 in the vicinity of the developing roller 40, and is constituted such that the pressing portion is pressed against the developing roller 40 by elasticity of the blade main body.

Additionally, the toner emitted from the toner supply port 46 is supplied to the developing roller 40 by rotating the supply roller 42 and is positively friction charged between the supply roller 42 and the developing roller 40. Furthermore, the toner supplied onto the developing roller 40 enters between the developing roller 40 and the pressing portion of the layer thickness regulating blade 41 according to the rotation of the developing roller 40 and is held on the developing roller 40 as a thin layer with predetermined thickness.

At the side position of the developing roller 40, the photosensitive drum 37 is rotatably supported in an arrow direction (clockwise direction) in the drum cartridge 35 in a state in which it is opposite to the developing roller 40. This photosensitive drum 37 is formed of a photosensitive layer with a positive charging property, and the drum main body is grounded and the surface is made of polycarbonate or the like.

Above the photosensitive drum 37, the scorotron type charger 38 is arranged at a predetermined interval so that it does not contact the photosensitive drum 37. This scorotron type charger 38 is a scorotron charger for positive charging which generates a corona discharge from a charging wire such as tungsten or the like and is constituted such that the surface of the photosensitive drum 37 can be uniformly charged with positive polarity.

A transfer roller 39 is arranged under and opposite to the photosensitive drum 37, and is supported by the drum cartridge 35 so as to be rotatable in an arrow direction (counterclockwise direction). This transfer roller 39 is constituted such that a transfer bias is applied at the time of transfer, and the roller is made of conductive rubber material covered over a metal roller shaft.

As the photosensitive drum 37 is rotated, first, the surface of the photosensitive drum 37 is uniformly charged with positive polarity by the scorotron type charger 38, after which it is exposed by a laser beam from the scanner 26, and an electrostatic latent image is formed. After that, as it faces the developing roller 40, a toner with positive charge coated on the developing roller 40 due to the developing bias applied to the developing roller 40 is supplied to the electrostatic latent image formed on the surface of the photosensitive drum 37, i.e., to the exposed portion, on the surface of the photosensitive drum 37 which is initially uniformly positively charged, in which exposure has been performed by a laser beam and the electric potential has been lowered.

After that, a toner image coated onto the surface of the photosensitive drum 37 is transferred to the paper 3 by a transfer bias to be applied to the transfer roller 39 when the paper 3 enters between the photosensitive drum 37 and the transfer roller 39.

The fixing portion 28 is to the side of the processing portion 27, and is arranged downstream, in the transfer direction of the paper 3. The fixing portion 28 is provided with a thermal roller 47, a pressing roller 48 which presses the thermal roller 47, and a pair of transfer rollers 49 arranged on the downstream side of the thermal roller 47 and the pressing roller 48.

The thermal roller 47 has a metal tube shape and houses a heater formed of a halogen lamp, and is constituted such that it is heated by the heater.

Furthermore, the pressing roller 48 presses against this thermal roller 47 and is rotated by following the rotation of the thermal roller 47.

Additionally, in the fixing portion 28, the toner transferred onto the paper 3 in the processing portion 27 is thermally fixed while the paper 3 enters between the thermal roller 47 and the pressing roller 48. After that, the paper 3 is transferred to the paper ejecting path 50 of the paper ejecting portion 6 by the transfer roller 49.

The paper ejecting portion 6 is provided with a paper ejecting path 50, a paper ejecting roller 51 as an ejecting means, and a paper ejecting tray 52 as a receiving surface. The paper ejecting path 50 is constituted as a route extended in an up/down direction from the transfer roller 49 to the paper ejecting roller 51 arranged above the transfer roller 49.

The paper ejecting tray 52 has a substantially rectangular plate shape in plan view. The rear end portion is arranged in the middle of the up/down direction between the transfer roller 49 and the paper ejecting roller 51. An inclined plate portion 53 which is upwardly inclined to the front side from the rear end portion is integrally formed so as to be continuous with a flat plate portion 54 which is formed in a flat shape in a substantially horizontal direction from the front end portion of the inclined plate portion 53, and of which the front end portion faces a free end portion of the upper side wall 18 of the front cover 16.

Furthermore, a stopper member 55 which stops the paper 3 to be ejected is arranged in the flat plate portion 54 of the paper ejecting tray 52.

That is, in the flat plate portion 54, a plan view substantially rectangular shaped concave portion is formed in the width direction substantially center portion, and the stopper member 55 is arranged in the concave portion. This stopper member 55 has a plan view substantially rectangular plate shape and is rotatably supported with respect to the flat plate portion 54 via a hinge 56 arranged in the front end portion. Furthermore, the stopper member 55 is constituted so as to be opened and closed with respect to the flat plate portion 54 as the rear end portion moves in a front-to-back direction, by using the hinge 56 arranged in the front end portion as a fulcrum. In an expanded state (state shown by imaginary lines of FIG. 1), it is arranged so that an angle of inclination to a front side upper direction becomes larger than the angle of the inclined plate portion 53; thus, the paper 3 that is ejected is prevented from falling from the front end portion of the paper ejecting tray 52.

Furthermore, the paper 3 sent to the paper ejecting path 50 by the transfer roller 49 is sent to the paper ejecting roller 51 and is ejected to the front side (front surface side) from the rear side (rear surface side) onto the paper ejecting tray 52 by the paper ejecting roller 51.

Additionally, in the printer main body 1, in order to form an image on both surfaces of the paper 3, a reverse transfer portion 57 as a double-sided printing means is arranged. This reverse transfer portion 57 is provided with a paper ejecting roller 51, a reverse transfer path 58, a flapper 59, and a plurality of reverse transfer rollers 60.

The paper ejecting roller 51 is constituted by a pair of rollers and is constituted such that positive rotation and reverse rotation can be switched. As described above, this paper ejecting roller 51 is rotated in a positive direction when the paper 3 is ejected onto the paper ejecting tray 52, but when the paper 3 is reversed, it is rotated in a reverse direction.

The reverse transfer path 58 is constituted as a route along an up/down direction so that the paper 3 can be transferred from the paper ejecting roller 51 to the plurality of reverse transfer rollers 60 arranged under the image formation portion 5. The upstream side end portion is arranged in the vicinity of the paper ejecting roller 51, and the downstream side end portion is arranged in the vicinity of the reverse transfer roller 60.

A flapper 59 is movably arranged so as to face a branch portion of the paper ejecting path 50 and the reverse transfer path 58. Through the excitation or non-excitation of an undepicted solenoid, the transfer direction of the paper 3 reversed by the paper ejecting roller 51 can be switched from a direction facing the paper ejecting path 50 to a direction facing the reverse transfer path 58.

Above the paper supply cassette 7, a plurality of reverse transfer rollers 60 are arranged in a substantially horizontal direction. The reverse transfer roller 60 that is farthest upstream is arranged in the vicinity of the rear end portion of the reverse transfer path 58, and the reverse transfer roller 60 that is farthest downstream is arranged under a resist roller 12.

Additionally, when an image is formed on both surfaces of the paper 3, the following shows how this reverse transfer portion 57 is operated. That is, when the paper 3 on which an image has been formed on one surface is sent to the paper ejecting roller 51 from the paper ejecting path 50 by the transfer roller 49, the paper ejecting roller 51 is positively rotated in a state in which the paper 3 is sandwiched, the paper 3 is temporarily transferred to outside (the paper ejecting tray 52 side), and the positive rotation of the paper ejecting roller 51 is suspended when most of the paper 3 is sent onto the paper ejecting tray 52 and the rear end of the paper 3 is sandwiched by the paper ejecting roller 51.

Next, the paper ejecting roller 51 is reversely rotated, the flapper 59 changes the transfer direction so that the paper 3 is transferred to the reverse transfer path 58, and the paper 3 is transferred to the reverse transfer path 58 in a front-to-back reverse direction state. Additionally, when the transfer of the paper 3 is completed, the flapper 59 is changed to the original state, i.e., to a state in which the paper 3 sent from the transfer roller 49 is sent to the paper ejecting roller 51.

Next, the paper 3 transferred to the reverse transfer path 58 in a reverse direction is transferred to the reverse transfer roller 60, is reversed to an upward direction from this reverse transfer roller 60, is sent to the paper supply path 10, and is sent to the resist roller 12. The paper 3 transferred to the resist roller 12 is again sent to an image formation position after resist in a reverse direction; thus, an image is formed on both surfaces of the paper 3.

Furthermore, in the reverse transfer portion 57 of this printer main body 1, the largest size of the paper 3 on which printing can be performed on both surfaces is set at A4 size.

Figure 2:
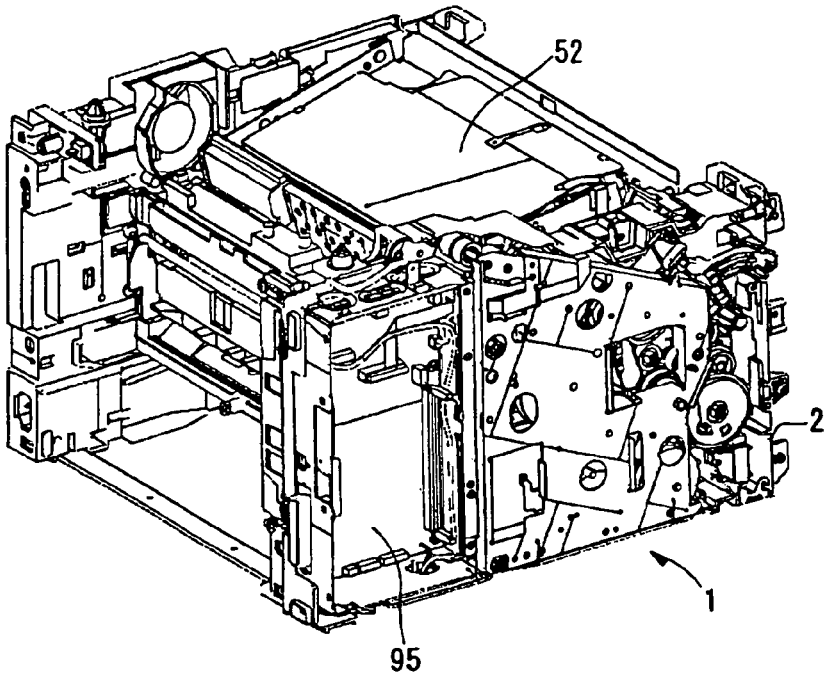
FIG. 2 is a perspective view of a printer main body shown in FIG. 1.

Additionally, as shown in FIG. 2, in the printer main body 1, a main substrate 95, as a circuit board which controls the respective portions of the combined machine F, is arranged on a side surface at the left rear side of the main body frame 2.

Furthermore, with respect to the combined machine F, an operation panel unit 71 (see FIG. 12) and a scanner unit 81 (see FIG. 12) are assembled in this printer main body 1.

The following explains a method of assembling this type of combined machine F with reference to FIGS. 2-19.

Figure 3:
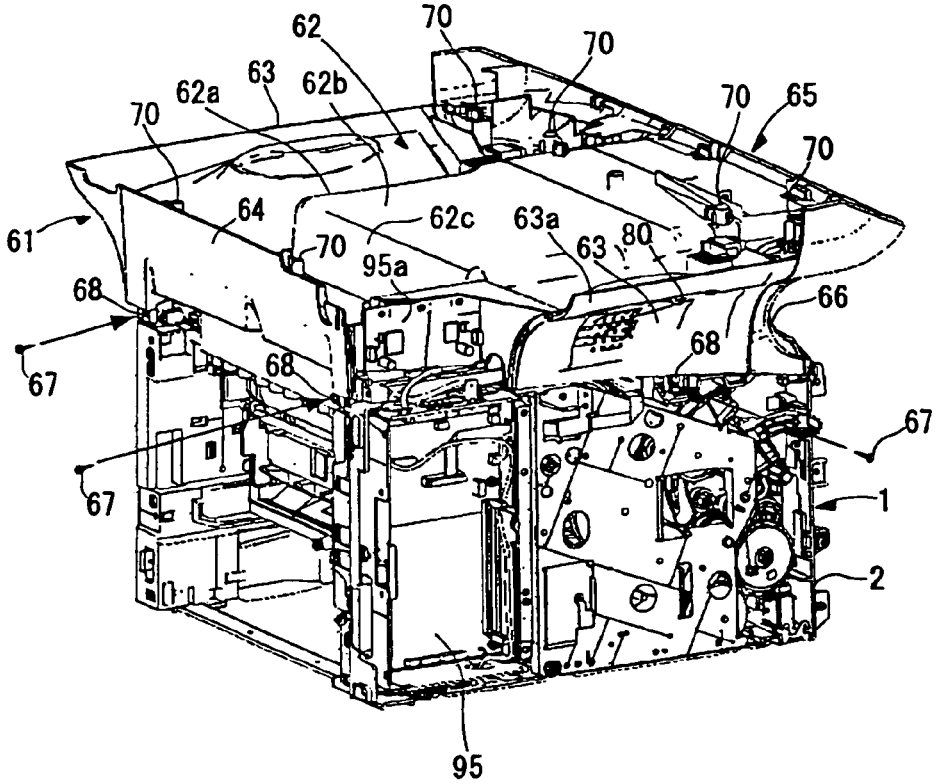
FIG. 3 is a perspective view in which a state where a joint cover is mounted to the printer main body shown in FIG. 1 is seen from a left rear side.
Figure 4:
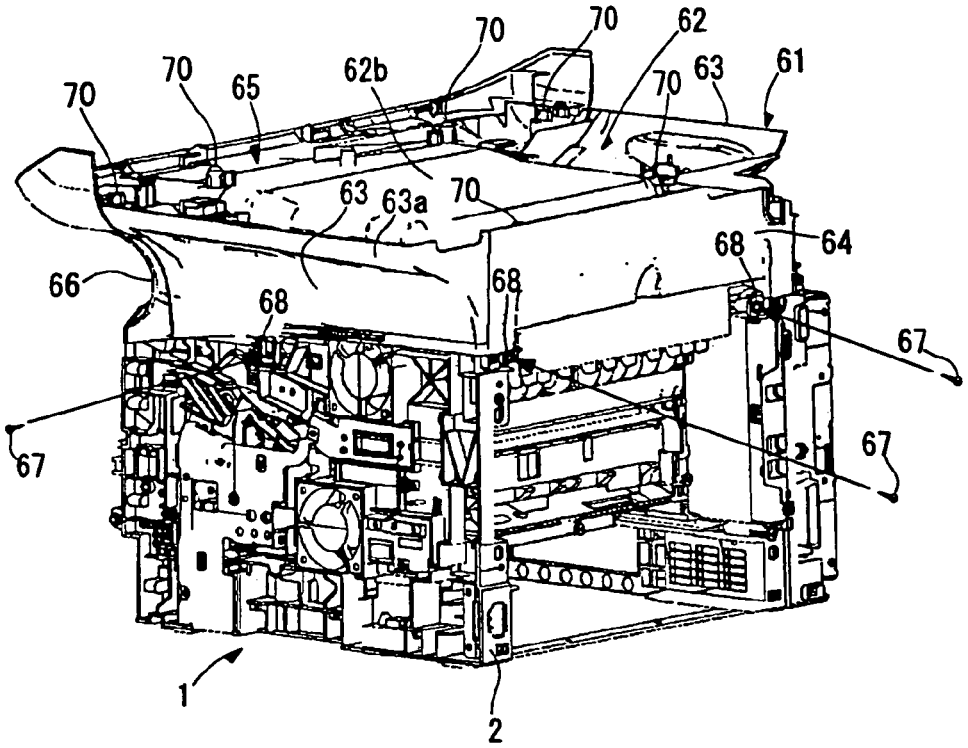
FIG. 4 is a perspective view in which a state where a joint cover is mounted to a printer main body shown in FIG. 1 is seen from a right rear side.

First, in this method, as shown in FIGS. 3 and 4, a joint cover 61, as a support member (an image reading device support member and an operation panel support member), is mounted to the main body frame 2 of the printer main body 1 shown in FIG. 2.

The joint cover 61 is molded of PS (polystyrene) resin without a reinforcement agent such as glass fibers. As shown in FIGS. 3 and 4, a scanner unit mounting portion 62 which covers the top portion of the main body frame 2 and in which the scanner unit 81 is mounted, side covers 63 as side walls covering both sides of the main body frame 2 in a width direction (right-to-left direction, hereafter the same), a rear cover 64 covering the rear side of the main body frame 2, and an operation panel unit mounting portion 65 which covers the upper front side of the main body frame 2 and in which the operation panel unit 71 is mounted, are integrally molded.

Figure 14:
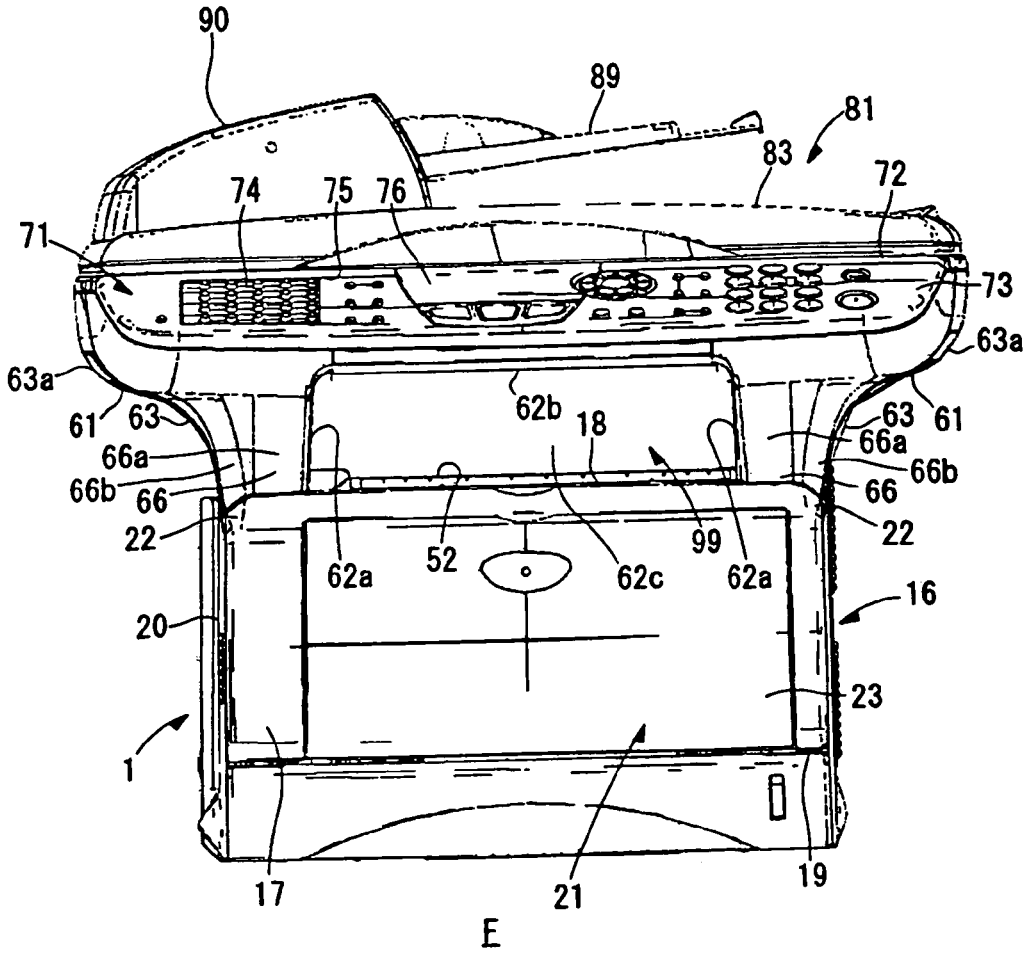
FIG. 14 is a front view (a state in which a document pressing cover is closed) showing the combined machine shown in FIG. 13.

As shown in FIG. 14, in the scanner unit mounting portion 62, at a position facing the paper ejecting tray 52, both side walls 62*a*, an upper wall 62*b*, and a back wall 62*c* are continuously formed. The portion surrounded thereby has a square shape, in front view, in which the lower portion and the front side are opened, and the internal side space makes a paper ejecting space in which the paper 3 in the later-mentioned paper ejecting portion 99 is ejected.

Additionally, both side walls 62*a* are formed so as to be continuous with the front side concave portions 66 of the respective side covers 63 which will be described later.

In a state in which the joint covers 61 are mounted to the main body frame 2, the side covers 63 are arranged by sandwiching the paper ejecting tray 52, and the lower end portion is formed with a width which can cover in the width direction both sides of the main body frame 2. Additionally, the side covers 63 are formed substantially in a mushroom shape, expanding from bottom to top, as seen in frontal view (see FIG. 14), and are curved so as to project outward from both sides of the main body frame 2 in the width direction as they extend from the lower end portion to the upper end portion (in particular, they are sharply curved in the vicinity of the upper end portion), and such that the projecting portions 63*a* of the upper end can receive the scanner unit 81.

Furthermore, on the lower surface of the projecting portions 63*a* of the side covers 63, holding portions 80 for lifting the combined machine F are arranged in a groove shape along the front-to-back direction (see FIGS. 15 and 16).

By forming the side covers 63 in this type of shape, the holding portions 80 of the projecting portions 63*a* which are projected to the right-to-left direction in the joint covers 61 can be held, and the combined machine F can be lifted and easily carried.

Additionally, the end portion of the front side (the downstream side, in the paper ejecting direction, hereafter the same) of the side covers 63 is curved inward in the width direction, and a front end concave portion 66 is formed as a concave portion which is depressed in a circular arc shape toward the rear side (the upstream side of the paper ejecting direction, hereafter the same) so that its center portion, in the up/down direction, at the front surface becomes the deepest (see FIGS. 15 and 16).

In addition, the deepest portion (i.e., the upstream side end portion, in the paper ejecting direction, of the front end concave portions 66) of the up/down direction center portion which is depressed on the furthest side in the respective front end concave portions 66 is farther forward than the front end portion 82*a* of the document table 82 of the later-described scanner unit 81 (see FIGS. 15 and 16). Also, at the time of both-sided printing, when an A4 size paper 3 on which an image has been formed on one surface is temporarily sent to the paper ejecting tray 52 by the paper ejecting roller 51, the deepest portion 66*a* is formed so as to be arranged farther forward than the rear end portion (i.e., front end portion in the front-to-back direction in the printer main body 1) M of the sent paper 3 (see FIG. 19).

Figure 19:
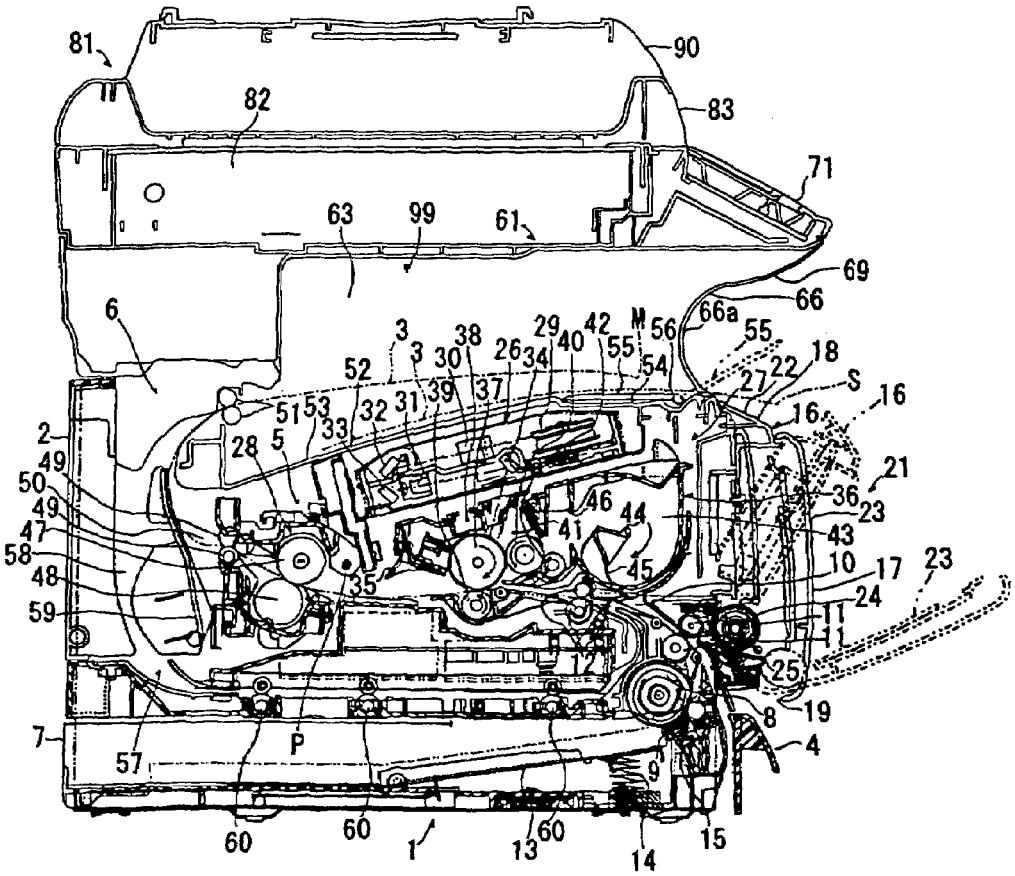
FIG. 19 is a main part side cross-sectional view (a state in which a document pressing cover is closed) showing the combined machine shown in FIG. 13.

Furthermore, the respective front end concave portions 66 are formed such that the deepest portion 66*a* of the respective front end concave portions 66 is farther forward than the front end portion of the stopper member 55 (the support side end portion on which the hinge 56 is arranged) in a housed state, and is arranged farther rearward than the rear end portion of the stopper member 55 (the free end portion opposite to the side on which the hinge 56 is arranged) in an open state (see FIG. 19).

Furthermore, the respective front end concave portions 66 of the respective side covers 63 are formed as curved inclined surfaces 66*b* in which the outside portion, in the width direction, of the front surface is inclined rearward at both outer sides (see FIG. 14).

Furthermore, as shown in FIGS. 3 and 4, in the middle of the front-to-back direction in the lower end portion of the respective side covers 63, as mounting portions in which tap tight type screws 67 are inserted, resin mounting portions 68 are formed which expand downwardly into a substantially rectangular shape.

A rear cover 64 is formed in a rear surface view substantially rectangular plate shape. On the width direction both side end portion of the lower end portion, in the same manner as in the side covers 63, resin mounting portions 68 as mounting portions in which tap tight type screws 67 are inserted are downwardly formed in a substantially rectangular shape.

On the front side of the scanner unit mounting portion 62, the operation panel unit mounting portion 65 is formed so as to project farther forward than the front end concave portions 66 of the side covers 63 (see FIGS. 15 and 16). An operation panel side continuation portion 69 which is continuous with the front end concave portions 66 of the side covers 63 in the operation panel unit mounting portion 65 is formed in a shape which is smoothly continuous with the front end concave portion 66 (see FIGS. 15 and 16).

Furthermore, the upper side of the operation panel unit mounting portion 65 is formed in substantially the same shape as the operation panel unit 71 in a plan view in order to receive the operation panel unit 71, and four screw seating portion 70 which screw the operation panel unit 71 are arranged at a predetermined interval in a width direction at a position facing the rear end portion of the operation panel unit 71.

Furthermore, in this joint cover 61, in the vicinity of the rear cover 64 of the scanner unit mounting portion 62 as well, two screw seating portions 70 which screw the document table 82 of the scanner unit 81 are arranged at a predetermined interval in the width direction.

In addition, as shown in FIG. 3, in this joint cover 61, on a side surface of the rear left side, a main substrate 95 of the printer main body 1 and a relay substrate 95*a* as a circuit board which relays a harness 96 in which the later-mentioned scanning motor 84*a* is electrically connected to the later-mentioned transfer motor 90*a* are arranged.

Figure 5:
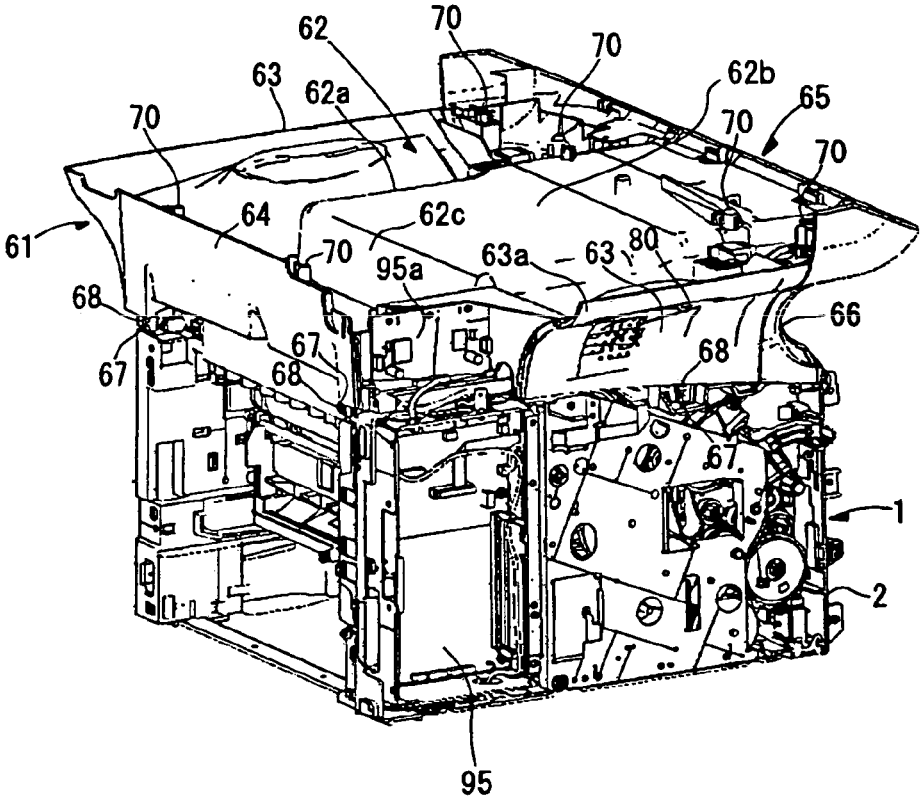
FIG. 5 is a perspective view in which a state where a joint cover is mounted to a printer main body shown in FIG. 1 is seen from a left rear side.

As shown in FIGS. 3 and 4, after this joint cover 61 is mounted on the top portion of the main body frame 2, the tap tight type screws 67 are inserted to the respective fixing portions 68 of the rear cover 64 and the respective side covers 63, and the respective screws 67 are engagingly mounted to the resin main body frame 2, and is mounted to the main body frame 2 as shown in FIG. 5.

More specifically, the screws 67 which are engagingly mounted via the fixing portions 68 are screwed in and fixed in the resin main body frame 2 while deforming a mounting portion of the main body frame 2 facing the fixing portions 68.

Thus, if the resin fixing portions 68 are fixed to the resin main body frame 2 via the screws 67, i.e., the mounting portions of the joint covers 61 and the printer main body 1 are both resin, thermal expansion and contraction of the respective portions can be made closer to each other, compared to the case in which the mounting portions are resin and metal. Because of this, distortion of the joint covers 61 and the printer main body 1 in the mounting portions can be reduced and rigidity of the device can be improved.

Figure 6:
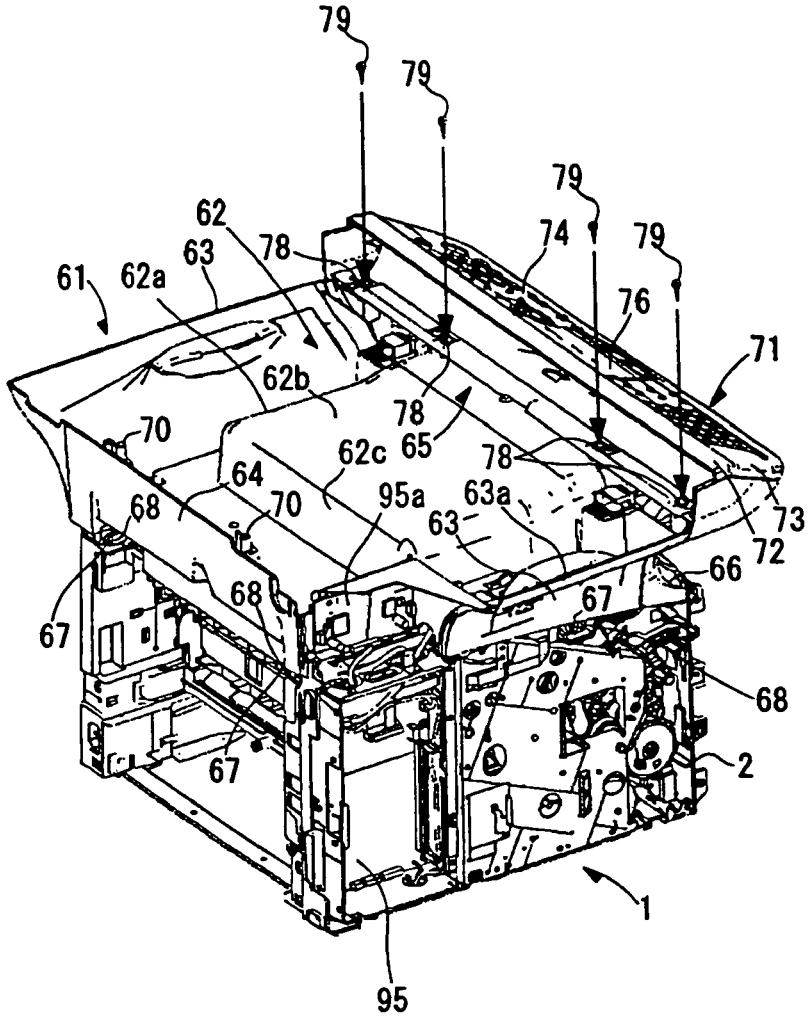
FIG. 6 is a perspective view in which a state where an operation panel unit is mounted to a joint cover shown in FIG. 5 is seen from a left rear side.
Figure 7:
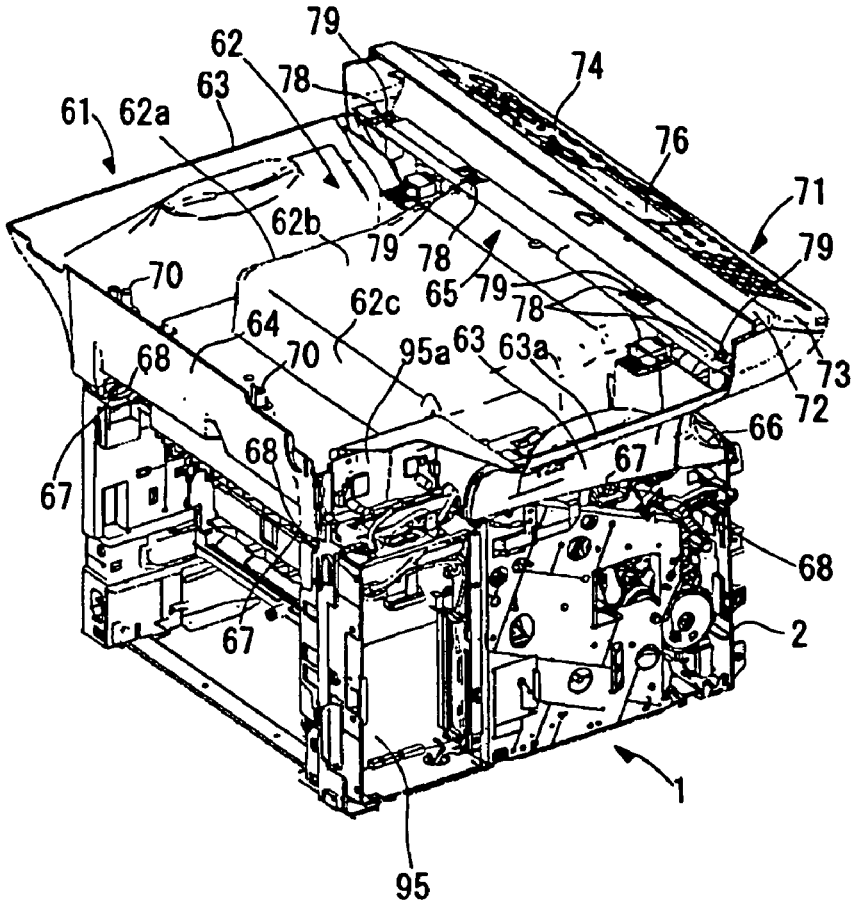
FIG. 7 is a perspective view in which a state where an operation panel unit is mounted to a joint cover shown in FIG. 5 is seen from a left rear side.

Next, in this assembly method, as shown in FIGS. 6 and 7, the operation panel unit 71 as an operation panel is mounted in the operation panel unit mounting portion 65 of the joint covers 61.

The operation panel unit 71 is formed in a substantially oblong rectangular plate shape, in plan view, separate from the scanner unit 81. In a state of being mounted to the joint covers 61, a flat shaped top end panel surface 72 adjacent to a later-mentioned document table 82 on substantially the same plane, and an inclined operation panel surface 73 which is curved and formed in a diagonally downward direction from the front end portion of the top end panel surface 72, opposite its side that is adjacent to the document table 82, are integrated. On the operation panel surface 73, various operation key groups 74 are arranged in which a user operates the printer main body 1 and the scanner unit 81.

Figure 18:
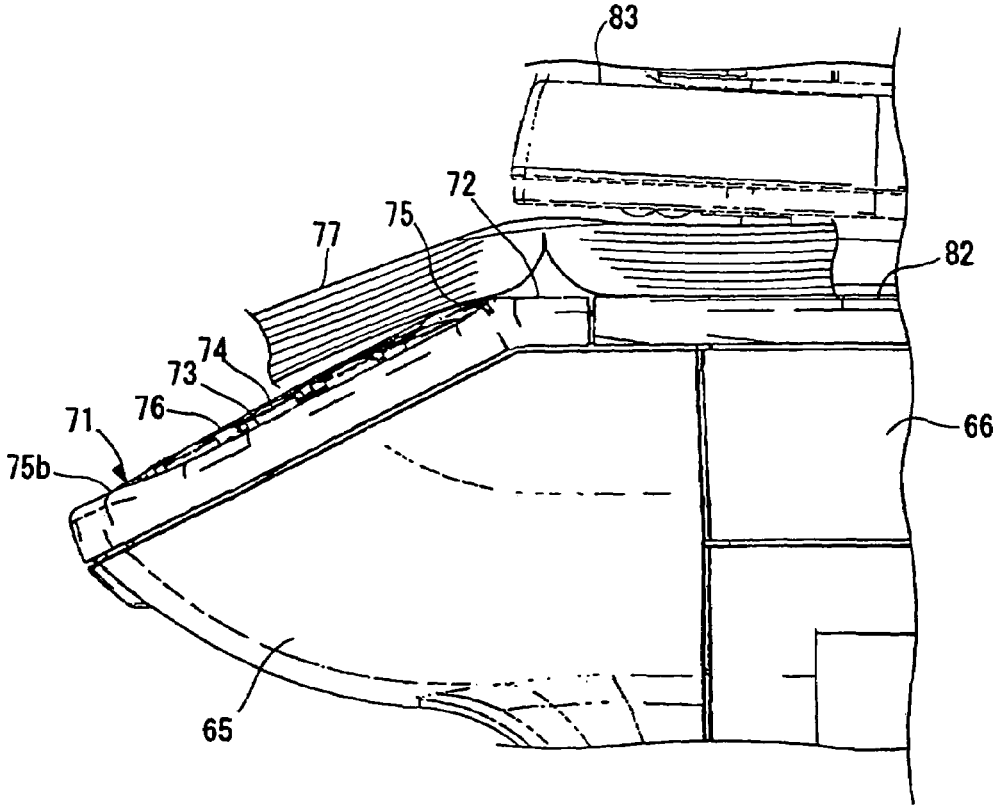
FIG. 18 is a main portion right side view showing an operation panel unit of the combined machine shown in FIG. 13.

Furthermore, in this operation panel unit 71, as shown in FIG. 18, on the document table 82 of the later-described scanning unit 81, if an opened book 77 is placed as a document, an upper restricting projecting portion 75, a lower restricting projecting portion 75*b*, and a cover plate 76 are arranged as accidental pressing restriction portions so that a portion of the book 77 does not press down the operation key groups 74 by mistake.

The upper restricting projecting portion 75 is formed by forming the operation panel surface 73 in a moderate projecting shape in the front-to-back direction, and such that the top end portion, extending the entire width of the operation panel surface 73 in the right-to-left direction, and which is continuous with the top end panel surface 72, curves so as to project upward at the curved portion of the boundary between the upper end panel surface 72 and the operation panel surface 73. By so doing, if the opened book 77 is placed on the document table 82, even if part of the book 77 covers the top portion of the operation key groups 74 of the operation panel surface 73, the upper restricting projecting portion 75 can prevent the book 77 from being bent along the curved portion of the boundary between the upper end panel surface 72 and the operation panel surface 73 and can prevent the book 77 from pressing the operation key groups 74.

The lower restricting projecting portion 75*b* is formed so that the lower end portion, extending the entire width of the operation panel 73 in the right-to-left direction, projects upward with respect to the operation panel surface 73 at a position farther forward than the operation key groups 74 of the operation panel surface 73. By so doing, if the opened book 77 is placed on the document table 82, as the book 77 contacts the upper restricting projecting portion 75 and the lower restricting projecting portion 75*b*, part of the book 77 can be prevented from pressing the operation key groups 74.

As shown in FIGS. 12 and 18, the cover plate 76 is arranged so as to cover a display portion arranged in the width direction center portion of the operation panel unit 71 and cover the front-to-back direction of the operation panel surface 73 at a predetermined spacing from the operation panel surface 73. This cover plate 76 is formed of a transparent resin plate and is formed so as to be slightly raised from the operation panel surface 73 in a state which covers the operation panel surface 73. By so doing, when the opened book 77 is placed on the document table 82, even if the part of the book 77 covers the top portion of the operation key groups 74 of the operation panel surface 73, the part of the book 77 is placed on this cover plate 76, so the operation key groups 74 can be prevented from being pressed down by the book 77.

Therefore, a document such as a book 77 read by the scanner unit 81 can be prevented from pressing the operation key groups 74 by mistake because of the upper restricting projecting portion 75, the lower restricting projecting portion 75*b*, and the cover plate 76, so mis-operation of the device can be prevented.

Furthermore, in this operation panel unit 71, as shown in FIG. 6, the rear end portion is formed at a height at which it can contact the screw seating portion 70 of the joint covers 61, and four mounting holes 78 are formed at a predetermined interval in the width direction of the rear end portion. In a state in which this operation panel unit 71 is mounted on the operation panel unit mounting portion 65, by inserting the screws 79 to the respective mounting holes 78 and engagingly mounting the respective screws 79 to the respective screw seating portions 70 arranged in the joint covers 61, as shown in FIG. 7, the operation panel unit 71 is mounted to the joint covers 61.

As shown in FIG. 19, the operation panel unit 71 which is thus mounted is arranged so as to project farther forward than the printer main body 1. Furthermore, the front end portion of the operation panel unit 71 is positioned on the front side from the free end portion (end portion opposite to the end portion of the side supported by an undepicted hinge) of the multi-purpose tray 23 in a housed state within the front cover 16 when it is not used, and is arranged so as to be positioned farther rearward, from the front cover 16, than the free end portion of the multi-purpose tray 23 in an opening state when it is used as shown by imaginary lines.

Next, in this assembly method, as shown in FIGS. 8-17, the scanner unit 81 is mounted to the joint covers 61.

As shown in FIG. 12, the scanner unit 81 is provided with the document table 82 and a document pressing cover 83 as a document pressing member which is mounted to the document table 82 so as to be openable and closable.

The document table 82 is formed in a substantially rectangular thick plate shape. On the top surface, a glass plate 85 is arranged as a substantially rectangular transparent plate on which a document is mounted. A CCD sensor 84 as a document reading means which reads a document and a scanning motor 84*a* (see FIG. 17) as a scanning drive source which scans the CCD sensor 84 in parallel to the glass plate 85 are contained therein.

The CCD sensor 84 is usually arranged on the left side from the glass plate 85. The scanning motor 84*a* (see FIG. 17) is in the vicinity of the CCD sensor 84, and more specifically, is housed at the rear left side of this document table 82. The CCD sensor 84 is scanned in the right-to-left direction so as to face the glass plate 85 by the drive of the scanning motor 84*a*.

Figure 8:
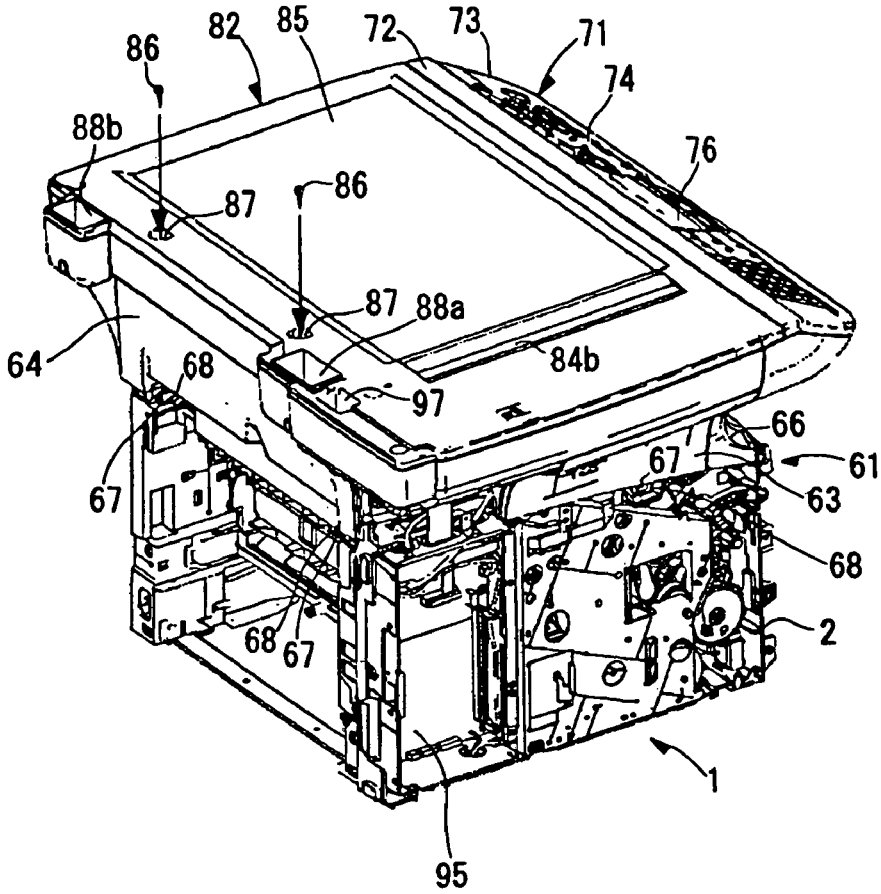
FIG. 8 is a perspective view in which a state where a document table is mounted to a joint cover shown in FIG. 7 is seen from a left rear side.

Furthermore, as shown in FIG. 8, in this document table 82, two through holes 87, through which pass fixing screws 86, are formed in the rear end portion at a predetermined interval in the width direction. Additionally, on this document table 82, a hinge mounting groove 88*a* and a hinge mounting groove 88*b*, in which a later-mentioned main hinge 91 and subhinge 92 are engaged to mount the document pressing cover 83 in a freely opening/closing state, are provided in the rear end portion at a predetermined interval in the width direction. Furthermore, the hinge mounting groove 88*a* in which the later-mentioned main hinge 91 is inserted is arranged in the rear left side of the document pressing cover 83, in the vicinity of the through hole 87, to the left of and behind the through hole 87.

Furthermore, on this document table 82, to the left of the hinge mounting groove 88*a* in which the later-mentioned main hinge 91 is inserted, as a through hole through which is inserted the harness 96 (see FIG. 11) as a connecting wire which electrically connects the transfer motor 90*a* of the later-mentioned ADF device 90 and the main substrate 95, a connecting opening 97 is formed so as to go through of the document table 82 in the up/down direction.

Figure 9:
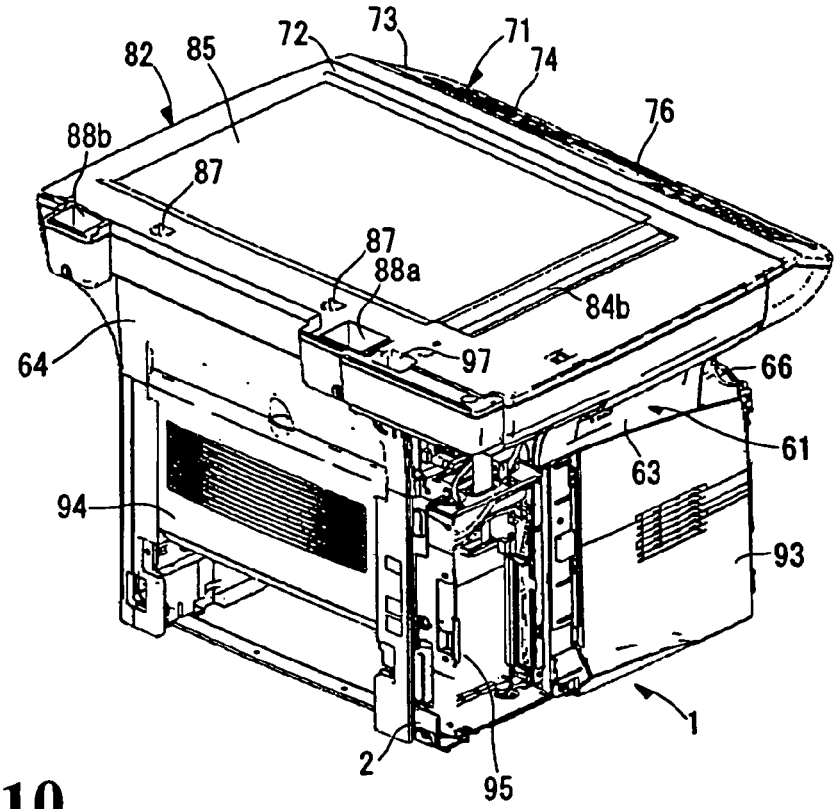
FIG. 9 is a perspective view in which a state where a document table is mounted to a joint cover shown in FIG. 7 is seen from a left rear side.
Figure 10:
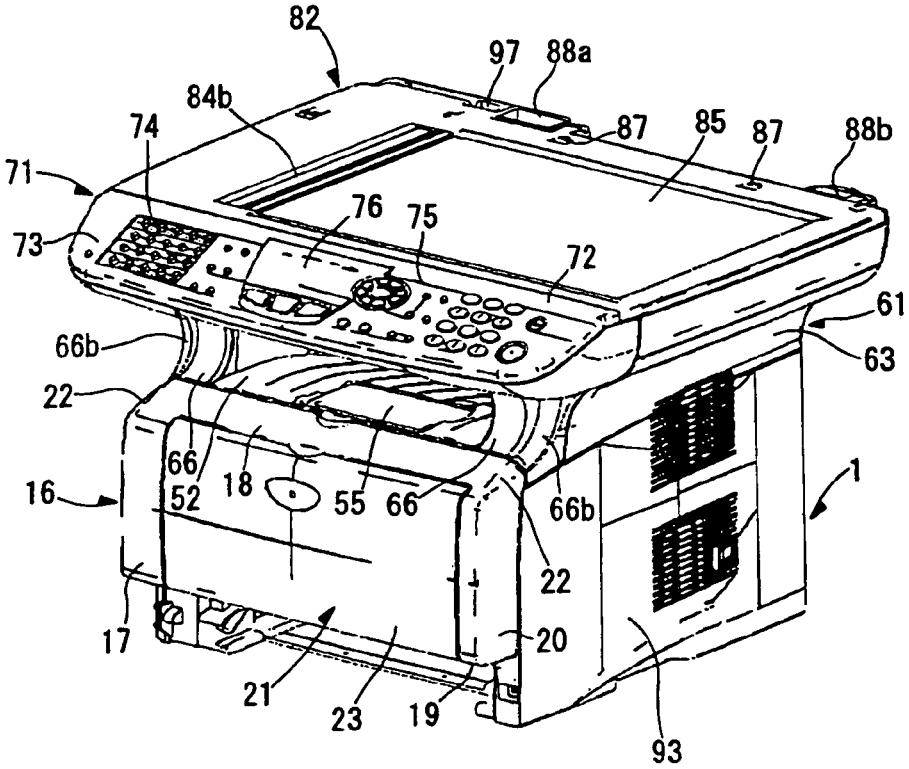
FIG. 10 is a perspective view in which a state where a document table is mounted to the joint cover shown in FIG. 7 is seen from a right front side.

Additionally, as shown in FIG. 8, after the document table 82 is mounted such that the front end portion is overlapped with the rear end portion of the operation panel unit 71 and the rear end portion is placed so that the respective through holes 87 face the respective screw seating portions 70 of the joint covers 61, the fixing screws 86 are inserted into the respective through holes 87, and the respective fixing screws 86 are engagingly mounted to the respective screw seating portions 70; thus, the document table 82 is mounted to the joint covers 61 as shown in FIGS. 9 and 10.

Furthermore, after the document table 82 is mounted to the joint cover 61, as shown in FIGS. 9 and 10, side cover members 93 are mounted to the both sides of the main body frame 2, and a rear cover member 94 is mounted to the rear side of the main body frame 2.

As shown in FIGS. 12 and 13, on the top surface of the document pressing cover 83 are arranged a document setting plate 89 as a document setting member on which stacked documents can be placed, and an ADF (Auto Document Feeder) device 90 as a document feeding means.

The ADF (Auto Document Feeder) device 90 is arranged on the rear left side of the document pressing cover 83 and is connected to the document setting plate 89 from the right side. In this ADF device 90 are arranged a transfer motor 90*a* (see FIG. 17) as a document feeding drive source, arranged within a motor cover 98 arranged on the rear left side of the document pressing cover 83, and an undepicted document detecting sensor. As described next, when the document detecting sensor detects a document to be set to the document setting plate 89, using the pressing down of a scan key as a trigger, the CCD sensor 84 is moved by the drive of the scanning motor 84*a* to an ADF document reading position 84*a* which is located on the left side of the glass plate 85, the document to be set on the document setting plate 89 is automatically transferred to the ADF document reading position 84*a* by the driver of the transfer motor 90*a*, and the document is read by the CCD sensor 84.

Figure 11:
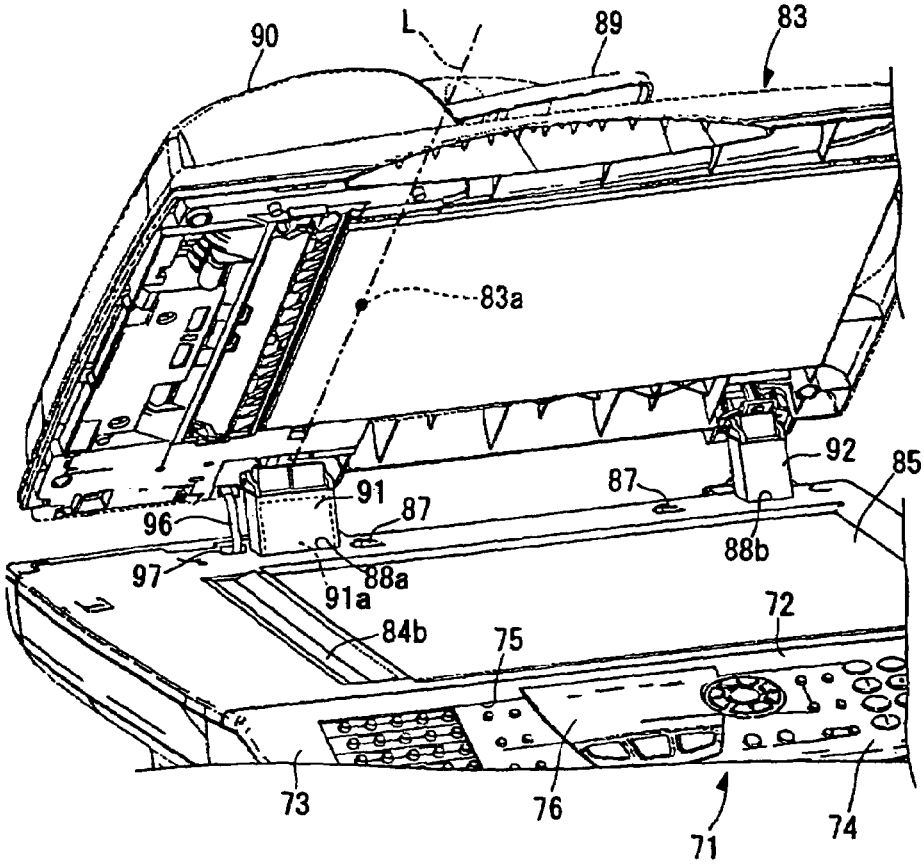
FIG. 11 is an enlarged perspective view in which a state where a document pressing cover is mounted to a document table shown in FIG. 10 is seen from a left front side.

Furthermore, in the document pressing cover 83, as shown in FIG. 11, in the rear end portion, as hinge members for mounting the document pressing cover 83 to the document table 82 in an openable/closable manner, the main hinge 91 and the subhinge 92 are arranged at a predetermined interval in a width direction.

With respect to the main hinge 91 and the subhinge 92, the lower end portion is formed in a substantially rectangular thick plate shape which can be engaged to the hinge mounting grooves 88 of the document table 82.

The center of gravity of this document pressing cover 83 is on the rear left side of the document pressing cover 83 because of the weight of the ADF device 90. On the rear left side, the main hinge 91 is arranged on line L that extends in the front-to-rear direction and substantially goes through the center of gravity position of the document pressing cover 83. In this main hinge 91, a torque generation mechanism 91*a* constituted by an undepicted spring, a cam and a slider is housed. The torque generation mechanism 91*a* generates an applied torque in a direction in which the document pressing cover 83 is opened with respect to the document table 82 when the document pressing cover 83 is opened at a predetermined angle or more with respect to the document table 82 (or generates a holding torque in that state).

By arranging this type of torque generation mechanism 91*a*, when the document pressing cover 83 is opened at a predetermined angle or more with respect to the document table 82, the document pressing cover 83 is urged in a direction in which the document pressing cover 83 is opened with respect to the document table 82 (or is held in that state) by the torque generated by the torque generation mechanism 91*a*. Therefore, even if an ADF device 90 with some weight, in which the transfer motor 90*a* or the like is contained, is arranged on the document pressing cover 83, falling of the document pressing cover 83 in a closing direction due to its own weight can be prevented so as to not heavily impact the document table 82.

Furthermore, by arranging the main hinge 91 containing this type of torque generation mechanism 91*a* on line L that extends into the front-to-rear direction and that goes through the center of gravity position of this document pressing cover 83, because of this main hinge 91, the document pressing cover 83 can be opened and closed about the line going through the center of gravity position as a rotation fulcrum. Therefore, the other subhinge 92 can be less expensive, without a torque generation mechanism 91*a* or the like, and the reliable opening/closing operation of the document pressing cover 83 can be ensured.

Additionally, as shown in FIG. 11, by inserting the main hinge 91 and the subhinge 92 of the document pressing cover 83 into the respective hinge mounting grooves 88*a* and 88*b* of the document table 82, as shown in FIGS. 12 and 13, the document pressing cover 83 is mounted to the document table 82 so as to be openable and closable.

Additionally, as shown in FIG. 11, the transfer motor 90*a* of the ADF device 90 is electrically connected to the main substrate 95 via the relay substrate 95*a* by the harness 96 going through the connecting opening 97 of the document table 82. Additionally, this is not depicted, but the scanning motor 84*a* which scans the CCD sensor 84 contained in the document table 82 is also electrically connected to the main substrate 95 via the relay substrate 95*a* by a harness that goes through the connecting opening 97 in the middle, in the up/down direction, of the connecting opening 97.

Additionally, after connection is completed by the harness 96 and an undepicted harness, as shown in FIG. 15, a substrate cover member 93*a* is mounted at a position facing the main substrate 95 of the main body frame.

Furthermore, in the combined machine F which is thus assembled, above the printer main body 1, the operation panel unit 71 and the scanner unit 81 are supported on the joint covers 61 mounted to the printer main body 1, and a coupling portion constituted by the joint covers 61 between the scanner unit 81 and the printer main body 1, including the upper side wall 18 of the front cover 16 and the paper feeding tray 52 of the printer main body 1, is a paper ejecting portion 99 which ejects the paper 3.

In this type of paper ejecting portion 99, an internal side space surrounded by both side walls 62*a*, the upper wall 62*b*, and the rear wall 62*c* in the joint covers 61 is a paper ejecting space in which the paper 3 is ejected, and the upper side wall 18 of the front cover 16 and the paper ejecting tray 52 of the printer main body 1 is a receiving surface which receives the ejected paper 3.

Furthermore, in this type of paper ejecting portion 99, the side cover 63 and the rear cover 64 of the joint covers 61 are arranged so as to be also used as an external wall of the paper ejecting portion 99.

Furthermore, in this scanner unit 81, for example, as shown in FIG. 12, after the document pressing cover 83 is opened and a document is placed on the glass plate 85 of the document table 82, if the document pressing cover 83 is closed and a scan key of the operation key groups 74 of the operation panel unit 71 is pressed, the CCD sensor 84 is scanned in the right-to-left direction opposite to the glass plate 85 of the document table 82 by the drive of the scanning motor 84*a*, and an image recorded on the document is thus read by the CCD sensor 84.

Additionally, for example, as shown in FIG. 13, if the document pressing cover 83 is closed, a document is set on the document setting plate 89, and a scan key from the operation key groups 74 of the operation panel unit 71 is pressed, an undepicted document detecting sensor detects the setting of the document to the document setting plate 89, the ADF device 90 automatically transfers documents to the CCD sensor 84 by the drive of the transfer motor 90*a*, the documents successively face the CCD sensor 84 arranged on the left end, and an image recorded on each document is thus read by the CCD sensor 84. Furthermore, the documents read by the CCD sensor 84 are ejected onto the top surface of the document pressing cover 83.

Thus, if the CCD sensor 84 and the ADF device 90 are independently driven by the scanning motor 84*a* and the transfer motor 90*a*, respectively, a reliable operation according to the document setting position can be ensured.

In particular, in the document pressing cover 83, the document setting plate 89 and the ADF device 90 are arranged, so if a plurality of documents are set in a stacked state in the document setting plate 89, the ADF device 90 successively automatically transfers the document to the CCD sensor 84 by the drive of the transfer motor 90*a*. Therefore, there is no need for placing a document on the glass plate 84 of the document table 82 one by one, and the document can be effectively read by the CCD sensor 84.

Additionally, in this combined machine F, data of the image read by the CCD sensor 84 is transmitted to the printer main body 1. In the printer main body 1, based on the data, by forming an image on the paper 3, a copying function can be accomplished.

Figure 21:
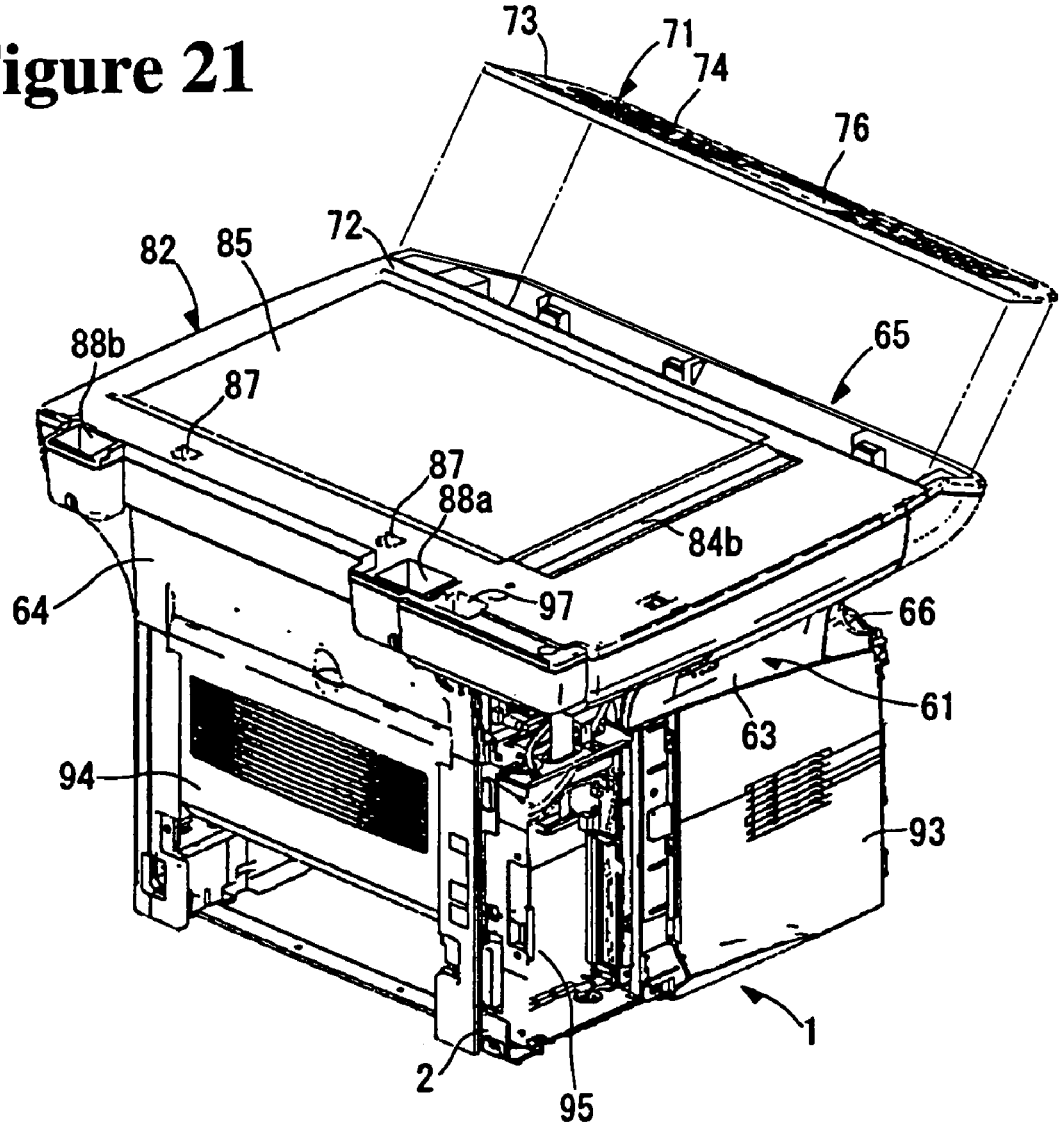
FIG. 21 is a diagram illustrating that operation units may be independently detached.

Furthermore, in this combined machine F, the joint covers 61 are mounted to the printer main body 1, and the operation panel unit 71 and the scanner unit 81 are mounted to the joint covers 61. Therefore, the operation panel unit 71 and the scanner unit 81 can be reliably assembled to the printer main body 1 via the joint covers 61. Because of this, the printer main body 1, the operation panel unit 71, and the scanner unit 81 are separately constituted, and the respective portions can be replaced independently, or the combination can be changed as shown in FIGS. 6 and 21. Additionally, they can be carried by holding the holding portions 80 of the joint covers 61 because of the reliable assembly.

Furthermore, in this combined machine F, by merely inserting the main hinge 91 and the subhinge 92 into the respective hinge mounting grooves 88*a* and 88*b* of the document table 82, the document pressing cover 83 can be mounted in an openable/closable state, using line L going through the center of gravity position 83*a* of the document pressing cover 83 as a rotation fulcrum, so the opening/closing operation of the document pressing cover 83 can be ensured by the simplified assembly.

Furthermore, line L is a line goes through the center of gravity position 83*a* and is substantially perpendicular to a center axis of opening/closing of the document pressing cover 83.

Furthermore, in this combined machine F, the main substrate 95 of the printer main body 1, the relay substrate 95*a* of the joint covers 61, the scanning motor 84*a* of the document table 82, and the driving motor 90*a* of the document pressing cover 83 are arranged on the same side, that is, on the rear left side of the combined machine F. Therefore, the length and routing of the harness 96 which electrically connects these can be shortened, the device structure can be simplified, and reliable connection can be ensured between the scanning motor 84*a* and driving motor 90*a* and the relay substrate 95*a* and main substrate 95.

In particular, the driving motor 90*a* of the ADF device 90 is electrically connected to the relay substrate 95*a* and the main substrate 95 via the harness 96, which goes through the connecting opening 97 of the document table 82 formed on the same side as the relay substrate 95*a* and the main substrate 95, that is, on the left rear side of the combined machine F. Therefore, the length and routing of the harness 96 can be further shortened, generation of electrical noise can be reduced, and the reliable connection between the driving motor 90*a*, the relay substrate 95*a*, and the main substrate 95 can be further ensured.

Additionally, in this combined machine F, in the document table 82, the hinge mounting groove 88*a* in which the main hinge 91 is inserted is arranged to the right of the connecting opening 97, that is, the connecting opening 97 is arranged on the same side, the rear left side, of the combined machine F as the main hinge 91 for closing and opening the document pressing cover 83 with respect to the document table 82. Therefore, the harness 96 can be prevented from being contacted and entangled by the document pressing cover 83 that is opened and closed. Because of this, a reliable operation of the device can be ensured.

Furthermore, in this type of assembly method, after the joint covers 61 are mounted to the printer main body 1, the operation panel unit 71 and the scanner unit 81 are mounted to the joint covers 61. Therefore, the printer main body 1, the scanner unit 81, and the operation panel unit 71 are separately constituted, the respective portions can be independently replaced, or the combination can be changed; thus, reliable assembly can be accomplished.

Furthermore, in this assembly method, in terms of assembling the scanner unit 81, after the document table 82 is mounted to the joint covers 61, the document pressing cover 83 is mounted to the document table 83, so the reliable assembly of the scanner unit 81 can be accomplished.

Furthermore, in this combined machine F, the front end concave portions 66 of the respective side covers 63 are formed so as to be depressed in a circular arc shape to the rear side; therefore, the scanner unit 81 is supported by the joint covers 61, and the ejected paper 3 can be easily removed even from the side direction from the depressed portion of the front end concave portions 66. Because of this, rigidity of the apparatus can be ensured, and operability can be improved.

Furthermore, in this combined machine F, as shown by point P of FIG. 19, the center of gravity of the combined machine F is in the vicinity of the rear of the scanner 26 of the printer main body 1, but with respect to the center of gravity P, the paper ejecting roller 51 is arranged on the rear side, and the front end concave portions 66 of the side covers 63 are arranged on the front side. Because of this, rigidity is provided to an extent in which the combined machine F can be carried by holding the holding parts 80 of the side covers 63. Because of this, the paper ejecting portion 99 is arranged between the scanner unit 81 and the printer main body 1, and sufficient rigidity can be ensured.

Furthermore, in the paper ejecting portion 99, the joint covers 61 are also used as an external wall, so rigidity of the apparatus can be ensured, and the number of parts can be reduced.

Furthermore, in this combined machine F, as shown in FIGS. 15 and 16, the deepest portion 66*a* of the front end concave portion 66 of the respective side covers 63 is arranged farther forward than the front end portion 82*a* of the document table 82 of the scanner unit 81, so in the side covers 63, sufficient rigidity to support the document table 82 can be ensured. Because of this, even if the document table 82 is strongly pressed by hand, damage of the apparatus can be prevented.

Furthermore, in this combined machine F, when both surfaces are printed, by temporarily sending the paper 3 on which an image has been formed on one surface to the paper ejecting portion 99 by the paper ejecting roller 51 of the reverse transfer portion 57, and again retracting it, the front and back of the paper 3 can be reversed. However, in the middle of this type of double-sided printing, when the A4 size paper 3 in which an image has been formed on one surface is temporarily sent onto the paper ejecting tray 52 by the paper ejecting roller 51, the deepest portion 66*a* of the front end concave portions 66 of the respective side covers 63 is arranged farther forward than the rear end portion M of the ejected paper 3 (see FIG. 19). Because of this, it is prevented that the paper 3 can be removed by a user by mistake while an image is not formed on other surface. Because of this, reliable double-sided printing can be ensured, and operability can be improved.

Furthermore, in this combined machine F, as shown in FIGS. 15 and 16, the operation panel unit 71 is arranged so as to be projected to the front side (front surface side) from the printer main body 1. Therefore, the operation panel unit 71 can be arranged closest to the front on the front side at which a user performs operations. Because of this, operability can be improved.

Furthermore, in this combined machine F, as shown in FIG. 19, the front end portion of the operation panel unit 71 is arranged farther forward than the free end portion (the end portion opposite to the end portion of the side supported by an undepicted hinge) of the multi-purpose tray 23, which is in a housed state within the front cover 16 when it is not in use, and as shown by imaginary lines, the front end portion of the operation panel unit 71 is arranged so as to be located farther rearward than the free end portion of the multi-purpose tray 23 in a state of being opened from the front cover 16 when it is in use.

Because of this, when the multi-purpose tray 23 is in a closed state, that is, when the multi-purpose tray 23 is not in use, the front end portion of the operation panel unit 71 is arranged farther forward than the free end portion of the multi-purpose tray 23, that is, in front of the multi-purpose tray 23 on the front surface side. Additionally, when the multi-purpose tray 23 is an open state, that is, when the multi-purpose tray 23 is in use, the front end portion of the operation panel unit 71 is arranged farther rearward than the free end portion of the multi-purpose tray 23, that is, the multi-purpose tray 23 is arranged in front of the operation panel unit 71 on the front side. Because of this, when the multi-purpose tray 23 is not used, operability of the operation panel unit 71 can be ensured, and when the multi-purpose tray 23 is used, operability of the multi-purpose tray 23 can be improved.

Furthermore, in this combined machine F, as shown in FIG. 19, with respect to the front end concave portion 66 of the respective side covers 63, the deepest portion 66*a* of the respective front end concave portions 66 is farther forward than the front end portion (the end portion on the support side in which the hinge 56 is arranged) of the stopper member 55 in a housed state, and is arranged farther rearward than the rear end portion (the free end portion opposite to the side in which the hinge 56 is arranged) of the stopper member 55 in an open state.

Because of this, when the stopper member 55 is in a closed state, that is, when the stopper member 55 is not in use, the deepest portion 66*a* of the respective front end concave portions 66 is farther forward than the stopper member 55, that is, the deepest portion 66*a* of the respective front end concave portions 66 is arranged in front of the stopper member 55 on the front side. Furthermore, when the stopper member 55 is in an open state, that is, when the stopper member 55 is in use, the deepest portion 66*a* of the respective front end concave portions 66 is arranged farther rearward than the stopper member 55, that is, the stopper member 55 is arranged in front of the deepest portion 66*a* of the respective front end concave portions 66 on the front side. Because of this, rigidity of the apparatus can be ensured, and when the stopper member 55 is used, the paper 3 stacked on the stopper member 55 can be easily removed from the side direction, and operability can be improved.

Furthermore, in this combined machine F, in the paper ejecting portion 99, the top surface of the upper side wall 18 of the front cover 16 are formed in a shape which is downwardly inclined in the direction from the rear side to the front side. Therefore, a space can be formed between a rear end portion S of the paper 3 ejected onto the paper ejecting tray 52 and the top surface of the upper side wall 18. Because of this, the paper 3 can be easily removed by hand from under the rear end portion S.

Furthermore, in this combined machine F, the front end concave portion 66 of the side covers 63 is formed so as to be depressed toward the rear side in a circular arc shape. Furthermore, the operation panel side continuation part 69 which is continuous with the front end concave portions 66 of the side covers 63 in the operation panel unit mounting portion 65 of the joint cover 61 is formed in a shape which is continuous with the front end concave portion 66 without a stepped portion. Furthermore, the main body side continuation portion 22 which is continuous with the front end concave portions 66 of the side covers 63 at both end portions in the width direction of the upper side wall 18 of the front cover 16 is formed as a shape which is continuous with the front end concave portions 66 without a stepped portion. Because of this, when the paper 3 is removed, the paper 3 can be prevented from being caught on the side covers 63 or at the boundary of the operation panel unit 71 side, the printer main body 1 side and the side covers 63. Because of this, the paper 3 can be suitably removed.

Furthermore, in this combined machine F, as shown in FIG. 12, the outer side portions, in the width direction, of the front surface of the front end concave portions 66 of the side covers 63 are formed as curved inclined surfaces 66*b* which are downwardly inclined toward the rear of the outer sides. Therefore, when the paper 3 is removed, the paper 3 can be prevented from being caught on the side covers 63. Furthermore, because of this type of inclined surface, rigidity can be improved.

Figure 20:
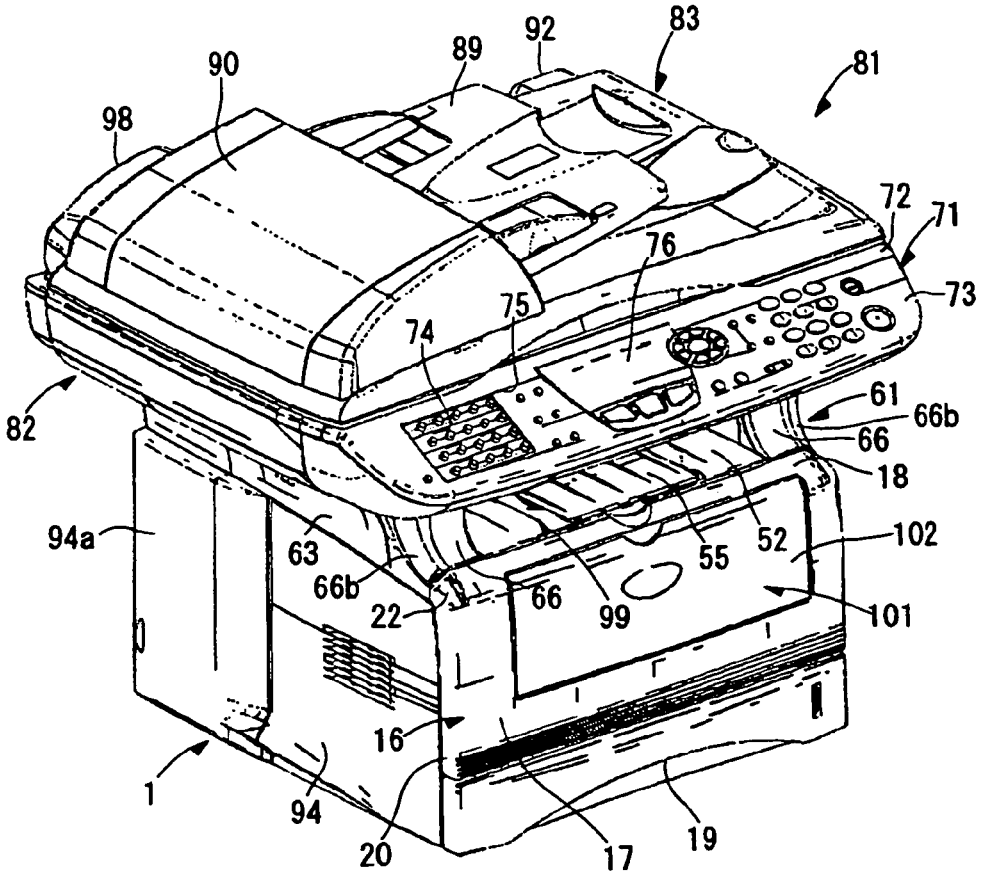
FIG. 20 is a perspective view (a state in which a document pressing cover is closed) showing a combined machine of another embodiment (mode in which a hand inserting tray is provided) as an image formation apparatus of this invention.

Furthermore, in the above-mentioned explanation, in the front surface of the front cover 16 of the printer main body 1, a multi-purpose paper supply portion 21 is provided in which different sizes of paper 3 can be stacked and supplied. However, for example, as shown in FIG. 20, instead of the multi-purpose paper supply 21, a hand inserting portion 101 at which paper 3 is inserted by hand can also be arranged. That is, in FIG. 20, as the hand inserting portion 101, a hand inserting tray 102 can be rotatably arranged as a recording medium support means which can be opened and closed in the front surface of the front cover 16.

Furthermore, the multi-purpose paper supply 21 and the hand inserting portion 101 are arranged so as to be opened and closed, but it can be arranged so as to be slidably moved.

Furthermore, in the above-mentioned explanation, the document setting member 89 and ADF device 90 are arranged in the document pressing cover 83, but depending on the purpose and usage, there are cases that a document pressing cover 83 is provided without a document setting member 89 or an ADF device 90.

In various exemplary embodiments of the present invention, the image formation apparatus main body, the image reading unit, and the operation panel unit are separately constituted, each parts can be independently replaced, or the combination can be changed; therefore, the support member can be held and carried by a reliable assembly.

In various exemplary embodiments of the present invention, rigidity of the apparatus can be improved by reducing distortion of the image formation apparatus main body and the support member in the mounting area.

In various exemplary embodiments of the present invention, the regulation projecting portion prevents the document to be read in the document table from pressing the operation key by mistake, and an accidental operation of the apparatus can be prevented.

In various exemplary embodiments of the present invention, as part of the book is placed on the restricted cover portion, a document such as a book to be read on the document table can be prevented from pressing the operation key by mistake, accidental operation of the apparatus can be prevented.

In various exemplary embodiments of the present invention, by using a simple assembly, a reliable opening/closing operation of the document pressing member can be ensured.

In various exemplary embodiments of the present invention, the document pressing member can be prevented from falling in the closing direction due to its own weight and severely impacting the document table.

In various exemplary embodiments of the present invention, the apparatus structure can be simplified, and a reliable connection of the driving source and the circuit substrate can be ensured.

In various exemplary embodiments of the present invention, the length and routing of the connecting wire which electrically connects to the driving source and the circuit substrate can be further shortened, and the apparatus structure can be further simplified, and reliable connection between the driving source and the circuit substrate can be ensured.

In various exemplary embodiments of the present invention, the document reading means and the document transfer means can be independently driven by the scanning driving source and the document transfer driving source, respectively, so an accurate operation can be ensured.

In various exemplary embodiments of the present invention, the holding portion is held, and the image formation apparatus is lifted and can be easily carried.

In various exemplary embodiments of the present invention, a reliable open/closing operation of the document pressing member can be ensured by a simple assembly.

In various exemplary embodiments of the present invention, without placing a document in the document table, the document can be read by the document reading means.

In various exemplary embodiments of the present invention, an image formation apparatus includes an image reading unit for reading an image recorded on a document, an image formation apparatus main body by which an image can be formed on a recording medium, based on image information read by the image reading unit, and an operation panel unit by which a user operates the image reading unit and the image formation apparatus main body, and which is provided separately from the image reading unit. The support member is provided which is mounted to the image formation apparatus main body and supports the image reading unit and the operation panel unit.

According to this structure, a support member is mounted to the image formation apparatus main body, and the image reading unit and the operation panel unit are mounted to the support member; therefore, the image reading unit and the operation panel unit can be securely assembled to the image formation apparatus main body via the support member. Because of this, the image formation apparatus main body, the image reading unit, and the operation panel unit are separately constituted, the respective parts can be independently replaced or the assembly can be changed, and the support member can be held and carried because of the reliable assembly.

In such embodiments, the image formation apparatus main body is provided with a resin mount receiving portion in which the support member is mounted, and the support member is provided with a resin mounting portion that mounts to the image formation apparatus main body.

According to this structure, the mount receiving portion of the image formation apparatus main body and the mounting portion of the support member are both made of resin. Therefore, in the mounting area where the mounting portion is mounted to the mount receiving portion, compared to the case in which one of the mount receiving portion of the image formation apparatus main body and the mounting portion of the support member is metal and the other is resin, thermal expansion and thermal contraction can be made more approximate to each other. Because of this, by reducing distortion of the support member and the image formation apparatus main body in the mounting area, rigidity of the apparatus can be improved.

Furthermore, in such embodiments, the image reading unit is provided with a document table on which a document is read, the operation panel unit is provided with an operation key, and an accidental pressing restriction portion is provided that prevents a document placed on the document table from pressing the operation key.

According to this structure, the accidental pressing restriction portion prevents the document to be read by the image reading unit from pressing the operation key by mistake, so accidental operation of the apparatus can be prevented.

Furthermore, in such embodiments, the operation panel unit is integrally provided with a flat upper end panel surface adjacent to the document table and an operation panel surface which is diagonally bent downwardly from the side opposite to the side adjacent to the document table at the upper end panel surface, and is provided with the operation key. The accidental pressing restriction portion is provided with a restricting projection portion which projects upwardly with respect to the operation panel surface at a boundary of the upper end panel surface and the operation panel surface.

According to this structure, when an opened book is placed in the document table, even if part of the book covers the upper portion of the operation key of the operation panel surface, the restricting projection portion prevents part of the book from following the bent portion of the boundary between the upper end panel and the operation panel surface. Because of this, the document such as a book to be read on the document table can be prevented from pressing the operation key by mistake, so accidental operation of the apparatus can be prevented.

Furthermore, in such embodiments, the operation panel unit is provided with an operation panel surface in which the operation key is arranged, and the accidental pressing restriction portion is provided with a regulation cover receiving portion which covers the upper portion of the operation panel surface at a predetermined spacing from the operation surface in a direction perpendicular to a right/left direction of the operation panel surface.

According to this structure, when an opened book is placed in a document table, even if part of the book covers the upper portion of the operation key of the operation panel surface, part of the book is placed on the regulation cover receiving portion, so the document such as a book to be read on the document table can be prevented from pressing the operation key by mistake, and accidental operation of the apparatus can be prevented.

Additionally, in such embodiments, the image reading unit is provided with a document table for reading a document, and a document pressing member for pressing a document placed on the document table and is mounted in an openable/closable manner with respect to the document table. In the document pressing member, at least one hinge member is arranged in order to close and open the document pressing member with respect to the document table. The hinge member is arranged on a line perpendicular to an opening/closing center axis of the document pressing member which goes through a centroid position of the document pressing member.

According to this structure, by merely mounting the hinge member to the document table, the document pressing member can be mounted to the document table in an openable/closable manner on the line going through the centroid position of the document pressing member as a rotation fulcrum, so a secure opening/closing operation of the document pressing member can be ensured by a simple assembly.

Furthermore, in such embodiments, in the hinge member, a torque generating mechanism is arranged which, when the document pressing member is released at a predetermined angle or more with respect to the document table, generates a torque which urges the document pressing member in a direction in which the document pressing member is released with respect to the document table, or holds the document pressing member as-is.

According to this structure, when the document pressing member is released at a predetermined angle or more with respect to the document table, because the torque generated by the torque generating mechanism urges the document pressing member in a direction of release from the document table or holds the document pressing member as-is, the document pressing member can be prevented from falling in a closing direction due to its own weight and severely impacting the document table.

Furthermore, in such embodiments, a driving source for reading a document is arranged on the image reading unit. A circuit substrate electrically connected with the driving source is arranged on the image formation apparatus main body or the support member. The driving source and the circuit substrate are arranged on the same side, in the right/left direction, in the image formation apparatus.

According to this structure, the driving source and the circuit substrate are arranged on the same side, in the right/left direction, of the image formation apparatus, so the length and routing of the connecting wire which electrically connects these components can be shortened, the apparatus structure can be simplified, and reliable connection between the driving source and the circuit substrate can be ensured.

Furthermore, in such embodiments, the driving source and the circuit substrate are arranged on the same side, in a front/back direction, of the image formation apparatus.

According to this structure, the driving source and the circuit substrate are arranged on the same side, in the front/back direction of the image formation apparatus, so the length and routing of the connecting wire which electrically connects these components can be further shortened, the apparatus structure can be further simplified, and reliable connection between the driving source and the circuit substrate can be ensured.

Additionally, in such embodiments, the driving source and the circuit substrate are electrically connected by a connecting wire, and a through hole through which the connecting wire passes is arranged in the image reading unit.

Additionally, in such embodiments, the through hole is arranged on the same side as the driving source and the circuit substrate in the right/left direction and the front/back direction of the image formation apparatus.

According to this structure, a through hole is arranged on the same side as the driving source and the circuit substrate in the right/left direction and the front/back direction of the image formation apparatus, so the length and routing of the connecting wire which electrically connects these components can be further shortened, the apparatus structure is further simplified, and reliable connection between the driving source and the circuit substrate can be ensured.

Additionally, in such embodiments, the image reading unit is provided with a document table for reading a document, and a document pressing member for pressing a document placed on the document table and mounted to the document table in an openable/closable manner. The document table is provided with a transparent plate on which a document is placed, and a document reading means for reading a document placed on the transparent plate. The document pressing member is provided with a document setting member for setting a document, and a document transfer means for transferring the document set on the document setting member to the document reading means. The driving source is provided with a scanning driving source which is arranged on the document table and scans the document reading means opposite to the transparent plate, and a document transfer driving source which is arranged on the document pressing member and drives the document transfer means.

According to this structure, the document reading means and the document transfer means can be independently driven by the scanning driving source and the document transfer driving source, respectively, so an accurate operation can be ensured.

Additionally, in such embodiments, the support member is provided with a projection portion which projects with respect to the image formation apparatus main body in the right/left direction of the image formation apparatus main body, and a grasping portion for lifting the image formation apparatus is arranged on the projection portion.

According to this structure, the image formation apparatus can be easily lifted by holding the holding portion.

In various exemplary embodiments of the present invention, an image formation apparatus includes an image reading device for reading an image recorded on a document, and an image formation apparatus main body which can form an image on a recording medium based on image information read by the image reading device. The image reading device is provided with a document table on which a document is read, and a document pressing member which is mounted to the document table in an openable/closable manner and presses a document placed on the document table. At least one hinge member for opening and closing the document pressing member with respect to the document table is arranged on the document pressing member, and the hinge member is arranged on a line perpendicular to an opening/closing center axis of the document pressing member which goes through a centroid position of the document pressing member.

According to this structure, by merely mounting the hinge member to the document table, the document pressing member can be mounted to the document table in an openable/closable manner on the line going through the centroid position of the document pressing member as a rotation fulcrum, so a secure opening/closing operation of the document pressing member can be ensured by a simple assembly.

Additionally, in such embodiments, a document reading means for reading a document is arranged on the document table. A document setting member for setting a document, a document transfer means for transferring the document set on the document setting member to the document reading means, and a document transfer driving source for driving the document transfer means are arranged on the document pressing member.

According to this structure, if a document is set to the document setting member of the document pressing member, the document transfer means is driven by the document transfer driving source, and the set document is transferred to the document reading means of the document table. Because of this, even if a document is not placed in a document table, the document can be read by the document reading means.

Additionally, in such embodiments, in the hinge member, a torque generating mechanism is arranged which, when the document pressing member is released at a predetermined angle or more with respect to the document table, generates a torque which urges the document pressing member in a direction in which the document pressing member is released with respect to the document table, or holds the document pressing member as-is.

According to this structure, when the document pressing member is released at a predetermined angle or more with respect to the document table, because the torque generated by the torque generating mechanism urges the document pressing member in a direction of release from the document table or holds the document pressing member as-is, the document pressing member can be prevented from falling in a closing direction due to its own weight and severely impacting the document table.

In various exemplary embodiments of the present invention, an image formation apparatus includes an image reading device for reading an image recorded on a document, and an image formation apparatus main body which can form an image on a recording medium based on image information read by the image reading device. A driving source for reading a document is arranged on the image reading device, a circuit substrate which is electrically connected to the driving source is arranged on the image formation apparatus main body or the support member, and the driving source and the circuit substrate are arranged on the same side, in the right/left direction, of the image formation apparatus.

According to this structure, the driving source and the circuit substrate are arranged on the same side, in the right/left direction, of the image formation apparatus, so the length and routing of the connecting wire which electrically connects these components can be shortened, the apparatus structure can be simplified, and reliable connection between the driving source and the circuit substrate can be ensured.

Additionally, in such embodiments, the driving source and the circuit substrate are arranged on the same side, in the front/back direction, of the image formation apparatus.

According to this structure, the driving source and the circuit substrate are arranged on the same side, in the front/back direction of the image formation apparatus, so the length and routing of the connecting wire which electrically connects these components can be further shortened, the apparatus structure can be further simplified, and reliable connection between the driving source and the circuit substrate can be ensured.

Additionally, in such embodiments, the driving source and the circuit substrate are electrically connected by a connecting wire, and a through hole through which the connecting wire passes is arranged in the image reading device.

According to this structure, the connecting wire electrically connects the driving source and the circuit substrate via a through hole arranged in the image reading device, so the length and extension of the connecting wire can be further shortened, and reliable connection between the driving source and the circuit substrate can be further ensured.

Additionally, in such embodiments, the through hole is arranged on the same side as the driving source and the circuit substrate in the right/left direction and the front/back direction of the image formation apparatus.

According to this structure, a through hole is arranged on the same side as the driving source and the circuit substrate in the right/left direction and the front/back direction of the image formation apparatus, so the length and routing of the connecting wire which electrically connects these components can be further shortened, the apparatus structure is further simplified, and reliable connection between the driving source and the circuit substrate can be ensured.

Additionally, in such embodiments, the image reading apparatus is provided with a document table for reading a document, and a document pressing member which is mounted to the document table in an openable/closable manner and presses the document placed on the document table. In the document pressing member, at least one hinge member is arranged which is mounted to the document table for closing and opening the document pressing member with respect to the document table. The through hole is arranged on the same side as the hinge member in the right/left direction and the front/back direction of the image formation apparatus.

According to this structure, a through hole is arranged on the same side, in the right/left direction and the front/back direction of the image formation apparatus, as the hinge member that allows the document pressing member to open and close with respect to the document table. Thus, the connecting wire can be prevented from being contacted by and entangled with the document pressing member which opens and closes. Because of this, a reliable operation of the device can be ensured.

Additionally, in such embodiments, the image reading device is provided with a document table for reading a document, and a document pressing member for pressing a document placed on the document table and which is mounted to the document table in an openable/closable manner. The document table is provided with a transparent plate on which a document is placed, and a document reading means for reading a document placed on the transparent plate. The document pressing member is provided with a document setting member for setting a document, and a document transfer means for transferring a document set on the document setting member to the document reading means. The driving source is provided with a scanning driving source arranged on the document table and which scans the document reading means opposite to the transparent plate, and a document transfer driving source which is arranged on the document pressing member and drives the document transfer means.

According to this structure, the document reading means and the document transfer means can be independently driven by the scanning driving source and the document transfer driving source, respectively, so an accurate operation can be ensured.

In various exemplary embodiments of the present invention, a method of assembling an image formation apparatus includes mounting a support member, which supports an image reading unit for reading an image recorded on a document, onto an image formation apparatus main body which forms an image on a recording medium; mounting an operation panel unit, by which a user operates the image reading unit and the image formation apparatus main body, to the support member; and mounting the image reading unit to the support member.

According to this method, after the support member is mounted to the image formation apparatus main body, the operation panel and the image reading unit are mounted to the supported member. Therefore, the image formation apparatus main body, the image reading unit, and the operation panel unit are separately constituted, each unit can be independently replaced or the assembly can be changed, and a reliable assembly can be accomplished.

Additionally, in such embodiments, the step of mounting the image reading unit to the support member includes the steps of: mounting a document table for reading a document to the support member; and mounting a document pressing member, which presses a document placed on the document table, to the document table.

According to this method, after the document table is mounted to the support member, by mounting the document pressing member to the document table, a reliable assembly of the image reading unit can be accomplished.

While particular embodiments have been described, alternatives, modifications, variations, improvements, and substantial equivalents that are or may be presently unforeseen may arise to Applicants or others skilled in the art. Accordingly, the appended claims as filed and as they may be amended are intended to embrace all such alternatives, modifications variations, improvements, and substantial equivalents.

What is claimed is:

1. An image formation apparatus, comprising:

a plurality of operating units; and a support member, wherein the plurality of the operating units comprises:

an image reading unit mounted to the support member, the image reading unit comprises a scanner that reads image information from a document; and an operation panel unit mounted to the support member, the operation panel unit comprises an operation panel that receives user inputs, wherein:

the image reading unit operates based on user input received at the operation panel unit, the image reading unit is independently removable from the support member while the operation panel unit is mounted to the support member, and the operation panel unit is independently removable from the support member while the image reading unit is mounted to the support member.

2. The image formation apparatus as set forth in claim 1, further comprising a main frame, the main frame comprising a mount receiving portion in which the support member is mounted, the support member comprising a mounting portion that mounts to the mount receiving portion of the main frame.

3. The image formation apparatus as set forth in claim 1, wherein the operation panel unit comprising:

an operation key;

an operation panel surface in which the operation key is arranged; and an accidental pressing restriction portion that prevents the document placed on a document table from pressing the operation key.

4. The image formation apparatus as set forth in claim 3, wherein the accidental pressing restriction portion comprises a restricted cover portion that covers an upper portion of the operation panel surface at a predetermined spacing in a direction perpendicular to a right/left direction of the operation panel surface.

5. The image formation apparatus as set forth in claim 1, wherein:

the image reading unit includes a document table on which a document is placed, and the operation panel unit includes:

an upper end panel surface having one side adjacent to the document table, and an opposite side that is adjacent to an operation panel surface, the operation panel surface containing an operation key and being bent downward in a direction away from the document table.

6. The image formation apparatus as set forth in claim 5, further comprising:

an accidental pressing restriction portion that comprises a restricted cover portion that covers an upper portion of the operation panel surface at a predetermined spacing in a direction perpendicular to a right/left direction of the operation panel surface.

7. The image formation apparatus as set forth in claim 1, wherein:

the image reading unit comprises a document table and a document pressing member that presses the document placed on the document table, the document pressing member being mounted in an openable/closable manner with respect to the document table, wherein the document pressing member comprises a hinge member that provides for the document pressing member to close and open with respect to the document table, the hinge member is arranged on a line perpendicular to an opening/closing center axis of the document pressing member, and the hinge member substantially goes through a centroid position of the document pressing member.

8. The image formation apparatus as set forth in claim 7, wherein the hinge member comprises a torque generating mechanism that, when the document pressing member is released to an angle that is equal to or greater than a predetermined angle with respect to the document table, generates a torque that urges the document pressing member in a direction in which the document pressing member is released with respect to the document table, or holds the document pressing member as-is.

9. The image formation apparatus as set forth in claim 1, wherein the image reading unit comprises a driving source, the image formation apparatus further comprising:

a circuit substrate electrically connected with the driving source and arranged on the main frame or the support member, wherein the driving source and the circuit substrate are arranged on a same side, in a right/left direction, of the image formation apparatus.

10. The image formation apparatus as set forth in claim 9, wherein the driving source and the circuit substrate are arranged on a same side, in a front/back direction that is perpendicular to the right/left direction, of the image formation apparatus.

11. The image formation apparatus as set forth in claim 9, wherein:

the driving source and the circuit substrate are electrically connected by a connecting wire, and the image reading unit comprises a through hole through which the connecting wire passes.

12. The image formation apparatus as set forth in claim 11, wherein the through hole is arranged on the same side as the driving source and the circuit substrate in the right/left direction and the front/back direction of the image formation apparatus.

13. The image formation apparatus as set forth in claim 9, wherein:

the image reading unit comprises a document table and a document pressing member that presses a document placed on the document table, the document pressing member being mounted to the document table in an openable/closable manner, the document table comprises a transparent plate on which the document is placed, and a document reading device that reads the document, and the document pressing member comprises a document setting member that sets the document before the document is placed on the transparent plate, and a document transfer device that transfers the document set on the document setting member to the document reading device and places the document on the transparent plate, and the driving source comprises a scanning driving source which is arranged on the document table and scans the document reading device on a side of the transparent plate that is opposite to a side on which a document is placed, and a document transfer driving source which is arranged on the document pressing member and drives the document transfer device.

14. The image formation apparatus as set forth in claim 1, wherein:

the support member comprises a projection portion that projects with respect to the main frame in a right/left direction of the main frame, and the projection portion comprises a grasping portion to lift the image formation apparatus.

15. An image formation apparatus comprising:

a document pressing member;

a document table on which a document is placed when the document is being scanned, the document table being configured so that the document is fed into the document table along a feeding direction;

a hinge that attaches the document pressing member to the document table, and hinges the document pressing member to close and open with respect to the document table, the hinge being located along a line that substantially extends through a centroid position of the document pressing member and that is substantially perpendicular to a rotational axis of the hinge, the rotational axis extending in a direction substantially parallel with the feeding direction; and a main frame that forms an image on a recording medium based on information scanned from the document.

16. The image formation apparatus as set forth in claim 15, further comprising:

an image reading unit, the image reading unit including the document table and the document pressing member, the document pressing member mounted to the document table in an openable/closable manner, wherein the document pressing member presses the document placed on the document table, and the reading unit reads image information from the document.

17. The image formation apparatus as set forth in claim 15, further comprising:

a document reading device arranged on the document table that reads a document, wherein the document pressing member comprises:

a document setting member that set a document;

a document transfer device that transfers the document set on the document setting member to the document reading device;

and a document transfer driving source that drives the document transfer device.

18. The image formation apparatus as set forth in claim 15, wherein the hinge comprises a torque generating mechanism that, when the document pressing member is released at an angle that is equal to or greater than a predetermined angle with respect to the document table, generates a torque which urges the document pressing member in a direction in which the document pressing member is released with respect to the document table, or holds the document pressing member as-is.

19. An image formation apparatus, comprising:

an image reading unit having a driving source, the driving source being a driving motor, the image reading unit comprising a scanner that reads image information from a document;

a circuit substrate electrically connected to the driving source; and a main frame that forms an image based on information read from the image reading unit, wherein the driving source and the circuit substrate are arranged on a same side, in a right/left direction, of the image formation apparatus, the arrangement of the driving source and the circuit substrate resulting in a small distance between the driving source and the circuit substrate.

20. The image formation apparatus as set forth in claim 19, further comprising:

a support member mounted to the main frame, wherein:

the image reading unit is mounted to the support member, and the circuit substrate is arranged on the main frame or the support member.

21. The image formation apparatus as set forth in claim 19, wherein the driving source and the circuit substrate are arranged on a same side, in a front/back direction that is perpendicular to the right/left direction, of the image formation apparatus.

22. The image formation apparatus as set forth in claim 21, wherein the driving source and the circuit substrate are electrically connected by a connecting wire, the image reading unit further comprises a through hole through which the connecting wire passes.

23. The image formation apparatus as set forth in claim 22, wherein the through hole is arranged on the same side as the driving source and the circuit substrate in the right/left direction and the front/back direction of the image formation apparatus.

24. The image formation apparatus as set forth in claim 23, wherein:

the image reading unit comprises a document table and a document pressing member which is mounted to the document table in an openable/closable manner and presses the document, and the document pressing member comprises a hinge member that is mounted to the document table so that the document pressing member is openable/closable with respect to the document table, wherein the hinge member is arranged on the same side as the through hole in the right/left direction and the front/back direction of the image formation apparatus.

25. The image formation apparatus as set forth in claim 19, wherein:

the image reading unit comprises a document and a document pressing member that presses the document placed on the document table, the document pressing member mounted to the document table in an openable/closable manner, the document table comprises a transparent plate on which the document is placed, and a document reading device that reads the document, the document pressing member comprises a document setting member that sets the document before the document is place on the transparent plate, and a document transfer device for transferring the document set on the document setting member to the document reading device and places the document on the transparent plate, and the driving source comprises a scanning driving source arranged on the document table and scans the document reading device on a side of the transparent plate that is opposite to a side on which the document is placed, and a document transfer driving source which is arranged on the document pressing member and drives the document transfer device.

26. A method of assembling an image formation apparatus, comprising:

providing a support member; and mounting a plurality of image formation operating units on the support member, wherein the plurality of the operating units comprises:

an image reading unit mounted to the support member, the image reading unit comprises a scanner that reads image information from a document; and an operation panel unit mounted to the support member, the operation panel unit comprises an operation panel that receives user inputs, wherein:

the image reading unit operates based on user input received at the operation panel unit, the image reading unit is independently removable from the support member while the operation panel unit is mounted to the support member, and the operation panel unit is independently removable from the support member while the image reading unit is mounted to the support member.

27. The method of assembling an image formation apparatus as set forth in claim 26, wherein:

mounting a plurality of image formation operating units comprises:

mounting an image reading unit on the support member, the image reading unit reading image information from a document; and mounting an operation panel unit on the support member, the operation panel unit receiving user inputs.

28. The method of assembling an image formation apparatus as set forth in claim 27, mounting an image reading unit comprising:

mounting a document table on the support member; and mounting a document pressing member on the document table, wherein the document table reads a document placed on the document table, and the document pressing member presses the document.

29. An image formation apparatus, comprising:

image reading means for reading image information from a document;

image formation means for forming an image based on the image information;

operation means for receiving user inputs and operating the image reading means and the image formation means based on the user inputs; and support means for supporting the image reading means, the operation means and the image formation means, so that the image reading means, the operation means and the image formation means are each separately removable from the supporting means, the image reading means comprising:

document reading means for reading a document placed on the documents means, the document reading means being configured so that the document is fed thereinto along a feeding direction;

document pressing means for pressing the document; and hinge means for hinging the document pressing means to close and open with respect to the document reading means, the hinge means being arranged on a line that is perpendicular to an opening/closing center axis of the document pressing means and that substantially goes through a centroid position of the document pressings means, wherein the opening/closing center axis extends in a direction substantially parallel with the feeding direction.

30. The image formation apparatus as set forth in claim 15, the centroid position being distal from the axis.

31. The image formation apparatus as set forth in claim 15, wherein the document table has a substantially rectangular shape having four sides including a first side and a second side that are substantially parallel with and disposed opposite to each other, further comprising:

an operational panel attached along the first side, wherein the hinge is located at the second side.

* * * * *